US005965972A

United States Patent [19]

Takada et al.

[11] Patent Number: 5,965,972

[45] Date of Patent: Oct. 12, 1999

[54] FIELD EMISSION COLD CATHODE WITH BURIED INSULATOR LAYER

[75] Inventors: Naruaki Takada; Yoshino Tomihari; Tadahiro Matsuzaki, all of Tokyo, Japan

[73] Assignee: NEC Corporation, Tokyo, Japan

[21] Appl. No.: 08/864,372

[22] Filed: May 28, 1997

[30] Foreign Application Priority Data

May 28, 1996 [JP] Japan ..... 8-133959
Dec. 17, 1996 [JP] Japan ..... 8-336601

[51] Int. Cl.[6] ..... H01J 1/30

[52] U.S. Cl. ..... 313/309; 313/336; 313/351; 313/495

[58] Field of Search ..... 313/309, 336, 313/351, 495, 355, 306, 307, 308, 103 CN, 105 CN, 310, 422, 496, 497; 445/24, 50, 51; 438/20; 257/10

[56] References Cited

U.S. PATENT DOCUMENTS 5,656,887 8/1997 Voshell et al. ..... 313/496

FOREIGN PATENT DOCUMENTS 4-138636 5/1992 Japan .
8-106846 4/1996 Japan .
8-87957 4/1996 Japan .

*Primary Examiner*—Nimeshkumar D. Patel
*Assistant Examiner*—Joseph Williams
*Attorney, Agent, or Firm*—Sughrue, Mion, Zinn, Macpeak & Seas, PLLC

[57] ABSTRACT

A field emission cold cathode comprises an n-type silicon substrate (1), a plurality of sharp-pointed emitter cones (2) formed on the n-type silicon substrate (1), and a buried insulator layer (3) formed in the n-type silicon substrate (1) to surround each of underlying regions right under each emitter cone (2). An insulator layer (4) is formed on the n-type silicon substrate (1) and has a plurality of insulator holes so as to surround each emitter cone (2). A gate electrode (5) is formed on the insulator layer (4) and has a plurality of gate holes for extracting electrons from the emitter cones (2).

20 Claims, 34 Drawing Sheets

FIELD EMISSION COLD CATHODE WITH BURIED INSULATOR LAYER

BACKGROUND OF THE INVENTION:

This invention relates to a field emission cold cathode for emitting electrons in response to an electric field applied between an electron source or emitter and a gate electrode without heating the emitter.

Generally, a field emission cold cathode comprises a semiconductor substrate operable as a part of an emitter, a plurality of sharp-pointed emitter cones formed on the semiconductor substrate, and a gate electrode having a plurality of gate holes each of which is formed around a tip of each emitter cone. The field emission cold cathode is responsive to an electric field applied between the emitter cones and the gate electrode to emit electrons from the tip of each emitter cone.

Description will hereafter be made about a typical field emission cold cathode as a first conventional device.

Referring to FIG. 1, the first conventional device comprises an n-type silicon substrate 31, a plurality of sharp-pointed emitter cones 32 formed on the n-type silicon substrate 31 as an emitter array, and a gate electrode 34 having a plurality of gate holes for passage of electrons emitted from tips of the emitter cones 32. Typically, an insulator layer 33 is interposed between the n-type silicon substrate 31 and the gate electrode 34. The insulator layer 33 has a plurality of insulator holes so as to surround each emitter cone 32.

In the first conventional device of the above-mentioned structure, spike noise of a large amplitude may often be caused to occur when it is switched on. Following occurrence of the spike noise, discharge may instantaneously be caused between the gate electrode 34 and the emitter cones 32.

In case where the discharge is continued, the emitter cones 32 will generate heat and begin to melt. Melted portions of the emitter cones 32 are splashed and adhered to the gate electrode 34 to result in short circuit between the gate electrode 34 and the emitter cones 32.

In order to avoid such short circuit between the gate electrode and the emitter cones 32 resulting from the continuous discharge, proposal is made of modified field emission cold cathodes which will hereunder be described as second and third conventional devices.

Referring to FIG. 2, the second conventional device comprises a resistor layer 35 interposed between the n-type silicon substrate 31 and the emitter cones 32. The resistor layer 35 has a high resistance and serves to restrict an electric current flowing to the emitter cones 32. With this structure, the electric current is suppressed to a level such that the above-mentioned short circuit does not occur.

Referring to FIG. 3, the third conventional device disclosed in Japanese Unexamined Patent Publication (JP-A) No. 87957/1996 comprises a plurality of field effect transistors (FET) in one-to-one correspondence to the emitter cones 32. Specifically, for each emitter cone 32, two n-type regions 37 are formed in a p-type silicon substrate 36. One of the n-type regions 37 serves as an FET source region with an FET source electrode 39 mounted thereon while the other n-type region 37 serves as an FET drain region. The emitter cone 32 is located on the drain region. An FET gate electrode 38 is located on the insulator layer 33 between the FET source and the FET drain regions both of which are formed in the p-type silicon substrate 36.

With this structure, the electric current flowing to the emitter cone 32 can be controlled by an input voltage applied to the FET gate electrode 38 so as to flow a constant current to the emitter cone 32. It is thus possible to avoid occurrence of the discharge.

However, the above-mentioned second and the third devices have following disadvantages.

In the second conventional device, voltage drop becomes inevitably large due to the resistor layer 35. It is therefore required to increase a drive voltage applied between the gate electrode 34 and the emitter cones 32. As seen from the figure, the resistor layer 35 is continuously formed in common to the emitter cones 32, not separately in one-to-one correspondence thereto. If the emitter cones 32 are arranged at a smaller interval to increase the density, an electromagnetic interference between the emitter cones is inevitable in this structure. This makes it difficult to effectively control an emission current from each individual emitter cone 32. In addition, the resistor layer 35 has a central zone and a peripheral zone surrounding the central zone. The central zone is remote from the peripheral zone. In this connection the central zone of the resistor layer 35 has a higher resistance value than the peripheral zone. This results in an increase of voltage drop at the central zone. As a consequence, it is difficult to emit the electrons from the emitter cones 32 located nearer to the central zone.

On the other hand, the third conventional device comprises the FETs in one-to-one correspondence to the emitter cones 32. This inevitably requires a complicated manufacturing process and increases the production cost. In addition, the size of the device is increased because the FET is provided for each of the emitter cones 32. Furthermore, the density of the emitter cones 32 can not be increased.

Another field emission cold cathode is disclosed in Japanese Unexamined Patent Publication (JP-A) No. 106846/1996 and will hereunder be described as a fourth conventional device. The fourth conventional device has a groove around the gate electrode surrounding the emitter array of the emitter cones. With this structure, it is possible to prevent occurrence of a leak current at an outer peripheral edge of the emitter array where the emitter cones and the gate electrode are exposed.

However, in the fourth conventional device, it is impossible to avoid decrease of the resistance value in the semiconductor substrate at portions right under the emitter cones.

In the meanwhile, an electron emission characteristic is affected by a contact resistance between the bottom of each emitter cone and the silicon substrate. The contact resistance is increased with a decrease in contact area therebetween, namely, a decrease in bottom area of each emitter cone. With development of the semiconductor technology, a more and more finer structure is sought. As the structure becomes fine, the bottom area of each emitter cone also becomes small in area. Such a small bottom area or contact area brings about an increase of contact resistance as described above. This unfavorably affects the electron emission characteristic.

In fact, a structure capable of avoiding the increase in contact resistance is already proposed in Japanese Unexamined Patent Publication (JP-A) No. 138636/1992 and will hereunder be described as a fifth conventional device. The fifth conventional device comprises a silicide layer as an interface between the silicon substrate and the emitter cones. The presence of the silicide layer serves to suppress the increase of contact resistance.

However, even with the fifth conventional device, it is difficult to overcome the increase of contact resistance resulting from drastic decrease in size of emitter cones following the rapid development in semiconductor technology.

In addition, if the silicide layer is excessively thick, the emitter cones may be inclined or lowered in height.

SUMMARY OF THE INVENTION

It is an object of this invention to provide a field emission cold cathode capable of preventing continuous discharge and to provide a method of manufacturing the same.

It is another object of this invention to provide a field emission cold cathode capable of preventing continuous discharge and resultant destruction of an emitter cone without using an additional element, such as a resistor and an FET, connected to the emitter cone and to provide a method of manufacturing the same.

It is still another object of this invention to provide a field emission cold cathode capable of integrating a large number of emitter cones in a relatively small area and to provide a method of manufacturing the same.

It is yet another object of this invention to provide a field emission cold cathode capable of avoiding an increase of contact resistance between the bottom of an emitter cone and a silicon substrate without using a silicide layer interposed therebetween as an interface and to provide a method of manufacturing the same.

A field emission cold cathode to which this invention is applicable comprises a semiconductor substrate, a plurality of sharp-pointed emitter cones formed on the semiconductor substrate at a predetermined interval to form an emitter array, and a gate electrode formed above the semiconductor substrate and having a plurality of gate holes for extracting electrons from said emitter cones. According to this invention, the semiconductor substrate has a plurality of grooves each of which surrounds an underlying region right under each of the emitter cones. Each of the grooves is filled with an insulator to form a buried insulator layer surrounding each of the underlying regions.

With the above-mentioned structure, it is possible to prevent continuous discharge described above and resultant destruction of the emitter cones. This is because, since each of the underlying regions of the semiconductor substrate is surrounded by the buried insulator layer, positive holes are prevented from spreading in a direction along the surface of the semiconductor substrate. Therefore, even in occurrence of instantaneous discharge, the resistance value of the semiconductor substrate can be kept substantially constant so as to avoid continuous discharge.

Preferably, the field emission cold cathode described above further comprises a conductive layer formed on the semiconductor substrate to be separated by the grooves into a plurality of conductive layer portions. Each of the emitter cones is formed on each of the conductive layer portions.

Preferably, in the field emission cold cathode described above, each of the conductive layer portions is greater in area than the bottom of each corresponding emitter cone formed thereon.

With the above-mentioned structure, each conductive layer portion corresponds to each emitter cone and is greater in area than the bottom of each emitter cone. Therefore, the above-mentioned increase of contact resistance can be avoided.

The semiconductor substrate may comprise an n-type silicon substrate. The semiconductor substrate may further comprise a plurality of p-type regions formed under the grooves, respectively.

Each of the groove has a depth determined by an initial voltage upon discharge from a parasitic capacitance and an avalanche breakdown field.

The insulator filled in each of the grooves may comprise a silica glass film with boron and phosphorus mixed therein, a polysilicon film, or a field oxide film.

The gate electrode may be formed of a metal material selected from a group including W, Mo, and $WSi_2$. The emitter cones are formed of a metal material selected from a group including Mo, TiC, ZrC, Ni, TiN, and ZrN. The conductive layer is formed of a metal material selected from a group including W, Mo, and $WSi_2$.

Figure 1:
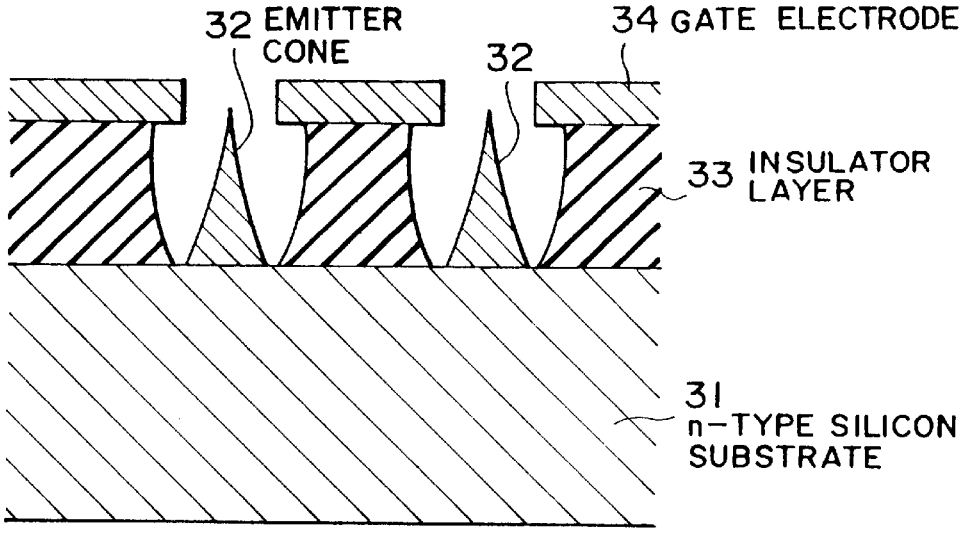
FIG. 1 PRIOR ART
FIG. 1 is a sectional view of a first conventional field emission cold cathode.
Figure 2:
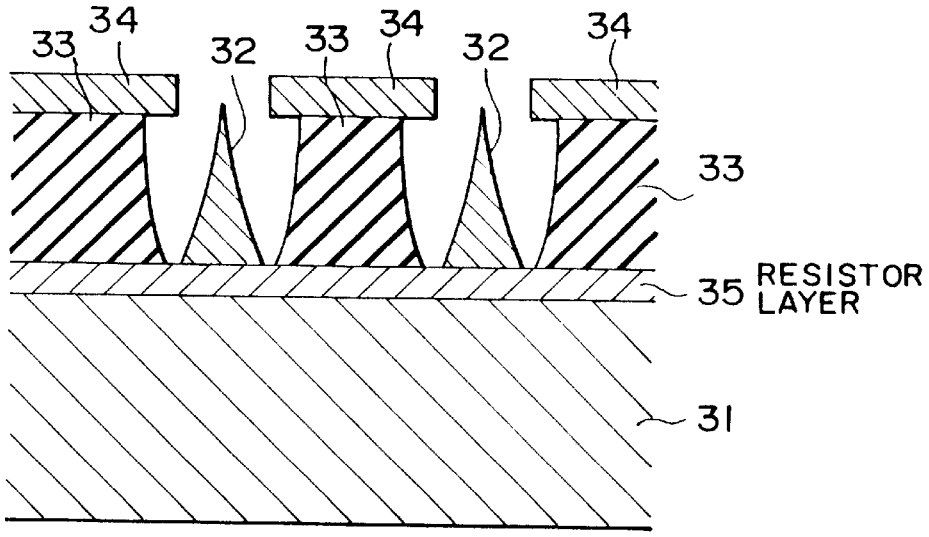
FIG. 2 PRIOR ART
FIG. 2 is a sectional view of a second conventional field emission cold cathode.
Figure 3:
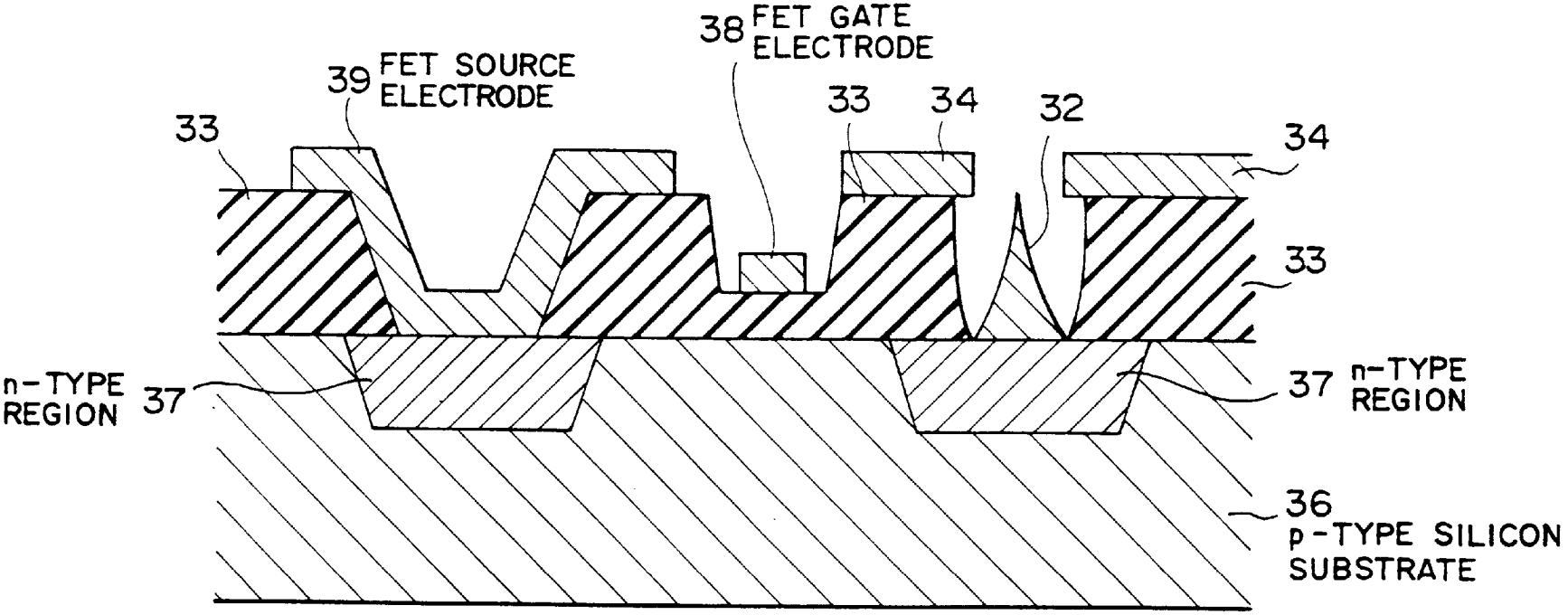
FIG. 3 PRIOR ART
FIG. 3 is a sectional view of a third conventional field emission cold cathode.

DESCRIPTION OF THE PREFERRED EMBODIMENT:

At first, description will be made about the concept of this invention in order to facilitate an understanding of this invention.

According to experimental studies of the present inventors, it has been found out that the spike noise of a large amplitude results from the parasitic capacitance inherent to the field emission cold cathode. In the first conventional device, the parasitic capacitance is a sum of an internal parasitic capacitance and an external parasitic capacitance. The internal parasitic capacitance typically stems from the insulator layer 33 between the gate electrode 34 and the n-type silicon substrate 31 while the external parasitic capacitance accompanies an external unit such as a power supply for applying an electric voltage to the gate electrode 34.

Now, consideration will be made about the relationship between the parasitic capacitance and the discharge caused between the gate electrode and the emitter cones following occurrence of the noise of a large amplitude.

At first, the emitter cone 32 generates heat while the electrons are emitted therefrom. In this event, a substance adsorbed to the emitter cone 32, for example, a fine residue of a material used upon formation of the emitter cone is gasified to locally decrease the degree of vacuum around the emitter cone 32. In this state, it is assumed that the electric voltage applied between the gate electrode 34 and the emitter cone 32 exceeds an allowable level. In this event, discharge from the parasitic capacitance is caused to occur and gives rise to the spike noise of a large amplitude. If any fine particles are adhered to the emitter cone 32, the distance between the emitter cone 32 and the gate electrode 34 is shortened. This brings about easier occurrence of the discharge.

Summarizing, the discharge is caused in the following conditions.

(1) The degree of vacuum around the emitter cone 32 is reduced.

(2) An electric current is allowed to smoothly flow (for example, the resistance value in a region under an electric field is decreased).

(3) The distance between the gate electrode 34 and the emitter cone 32 is shortened.

(4) The electric voltage applied between the gate electrode 34 and the emitter cone 32 exceeds the allowable level.

From the above-mentioned conditions, the reason of occurrence of the continuous discharge is supposed as follows.

Upon occurrence of instantaneous discharge, avalanche breakdown is caused so that pairs of electrons and positive holes are rapidly produced and increasingly spread in the silicon substrate. The electrons migrate from the silicon substrate to the emitter cones and can therefore be neglected. As a result, a large number of the positive holes are drastically increased in the silicon substrate at a region right under the emitter cone involved in the discharge. The positive holes spread in a direction along the depth of the silicon substrate and in another direction along the surface of the silicon substrate, i.e., towards another region right under another emitter cone adjacent to that involved in the discharge.

Spread of the positive holes along the depth of the silicon substrate causes no serious problem. However, spread of the positive holes along the surface of the silicon substrate drastically reduces the resistance value of the region right under the emitter cone involved in the discharge.

Such reduction in resistance value allows the electric current to more and more smoothly flow. Therefore, the discharge will continue until the device is completely broken and the gate electrode and the emitter cone are sufficiently apart from each other.

Now, description will be made about several preferred embodiments of this invention with reference to the drawing.

Figure 4:
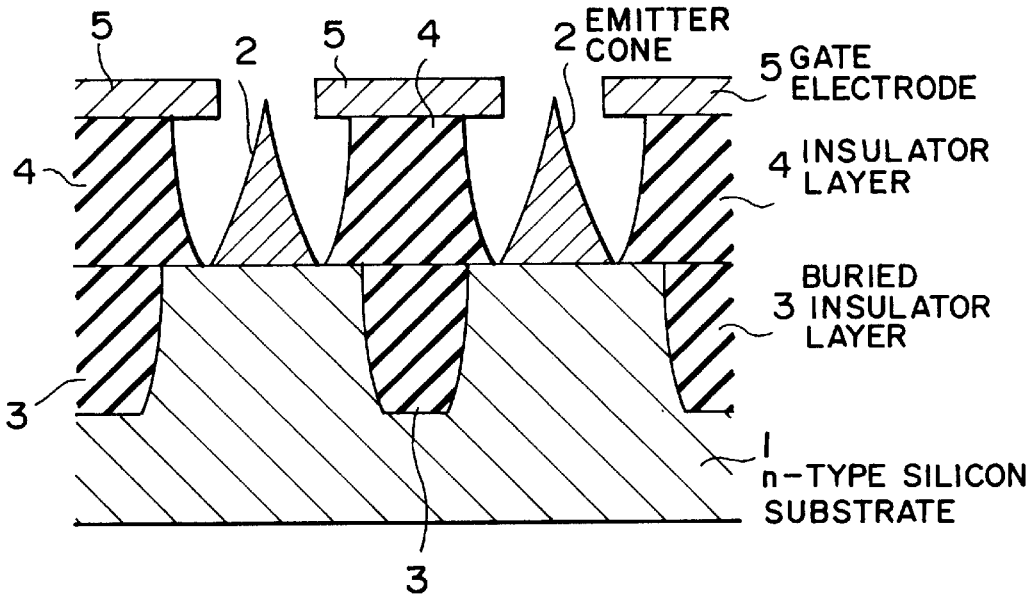
FIG. 4 is a sectional view for describing a concept of a field emission cold cathode according to this invention.

Referring to FIG. 4, a basic structure of a field emission cold cathode according to this invention will be described. The field emission cold cathode comprises an n-type silicon substrate 1, a plurality of sharp-pointed emitter cones 2 formed on the n-type silicon substrate 1 as an emitter array, and a buried insulator layer 3 filled in a plurality of grooves formed in the n-type silicon substrate 1. The buried insulator layer 3 surrounds each of underlying regions of the n-type silicon substrate 1 right under the emitter cones 2. An insulator layer 4 is formed on the n-type silicon substrate 1. The insulator layer 4 has a plurality of insulator holes so as to surround each emitter cone 2. On the insulator layer 4, a gate electrode 5 is formed. The gate electrode 5 has a plurality of gate holes for extracting electrons emitted from the emitter cones 2. Each insulator hole of the insulator layer 4 has a diameter not smaller than that of each gate hole of the gate electrode 5.

In the field emission cold cathode having the above-mentioned structure, each of the underlying regions is surrounded by the buried insulator layer 3. Therefore, even in occurrence of instantaneous discharge, positive holes never spread along the surface of the n-type silicon substrate 1. Thus, in the field emission cold cathode of this invention, the resistance value of the n-type silicon substrate 1 can be kept substantially constant even in occurrence of the instantaneous discharge. As a consequence, continuous discharge is effectively prevented.

The distance from the surface of the n-type silicon substrate 1 to the bottom of the buried insulator layer 3, i.e., the depth of the groove is determined with reference to an initial voltage upon discharge from a supposed parasitic capacitance and an avalanche breakdown field.

Herein, the avalanche breakdown field may have a typical value of 30 V/$\mu$m.

In this event, if the initial voltage upon discharge from the parasitic capacitance ranges between 30 and 100 V, the depth of the groove is determined between about 1 and 3.3 $\mu$m.

Description will proceed to several specific embodiments of this invention together with manufacturing processes.

First Embodiment

Figure 5:
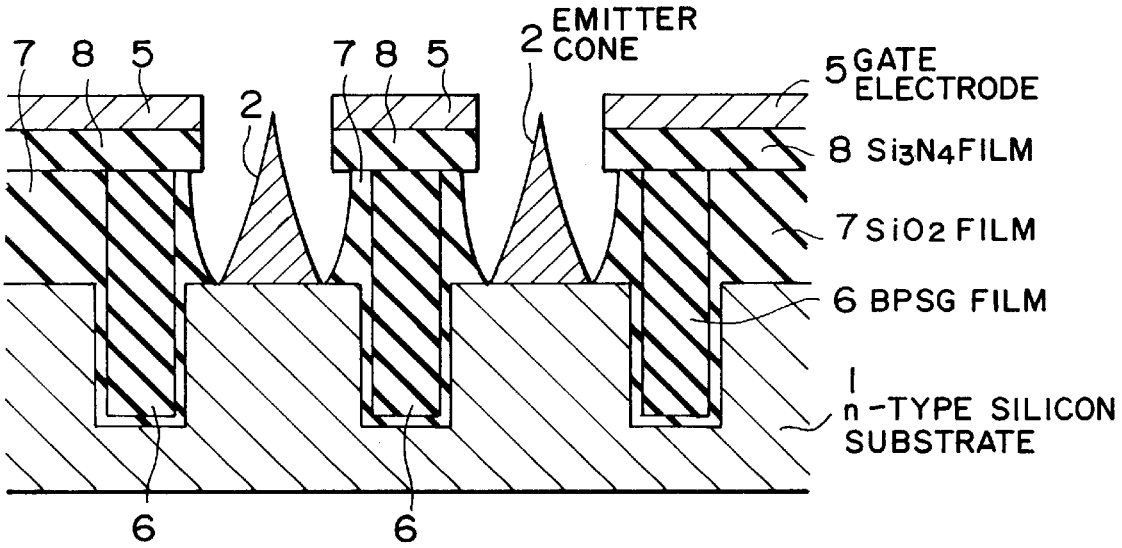
FIG. 5 is a sectional view of a field emission cold cathode according to a first embodiment of this invention.

Referring to FIG. 5, a field emission cold cathode according to a first embodiment of this invention comprises an n-type silicon substrate 1, a plurality of emitter cones 2, a gate electrode 5, a BPSG (borophosphosilicate glass) film 6, an $SiO_2$ film 7, and an $Si_3N_4$film 8.

In this embodiment, the buried insulator layer 3 in FIG. 4 is composed of a part of the BPSG film 6 filled in a plurality of grooves formed in the n-type silicon substrate 1 and a part of the $SiO_2$ film 7. The insulator layer 4 in FIG. 4 is composed of the other part of the BPSG film 6, the other part of the $SiO_2$ film 7, and the $Si_3N_4$ film 8.

The field emission cold cathode of this embodiment is capable of preventing continuous discharge as described above.

Next referring to FIGS. 6A through 6L, description will be made about a process of manufacturing the field emission cold cathode of the first embodiment.

Figure 6A:
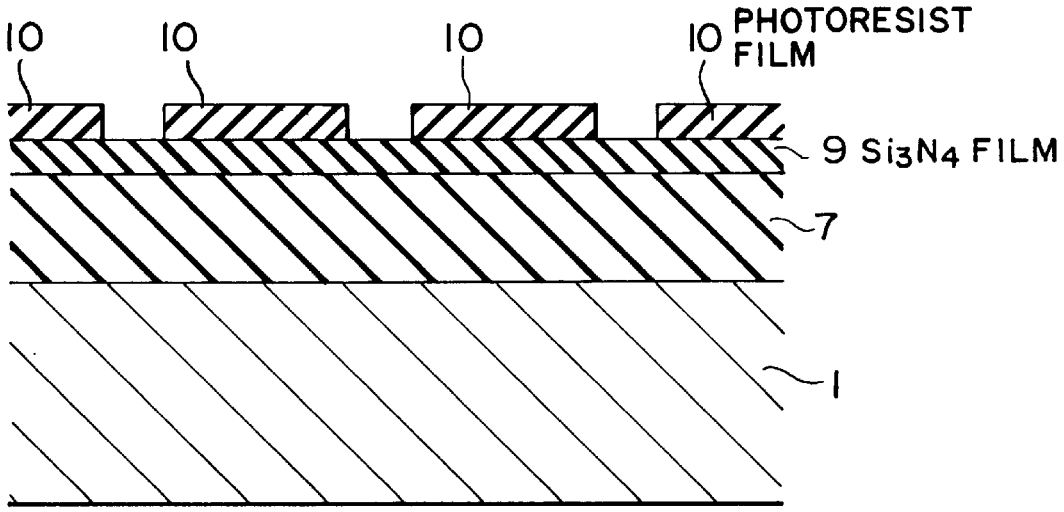
FIGS. 6A through 6L are views for describing a manufacturing process of the field emission cold cathode illustrated in FIG. 5.

As illustrated in FIG. 6A, the $SiO_2$ film 7 and an $Si_3$ $N_4$ film 9 are successively deposited on the n-type silicon substrate 1 to thicknesses of about $5000\times10^{-8}$ cm and about $1500\times10^{-8}$ cm, respectively. Then, on the $Si_3N_4$ film 9, a photoresist film 10 is applied except those regions above predetermined positions where the grooves are later formed in the n-type silicon substrate 1.

Figure 6B:
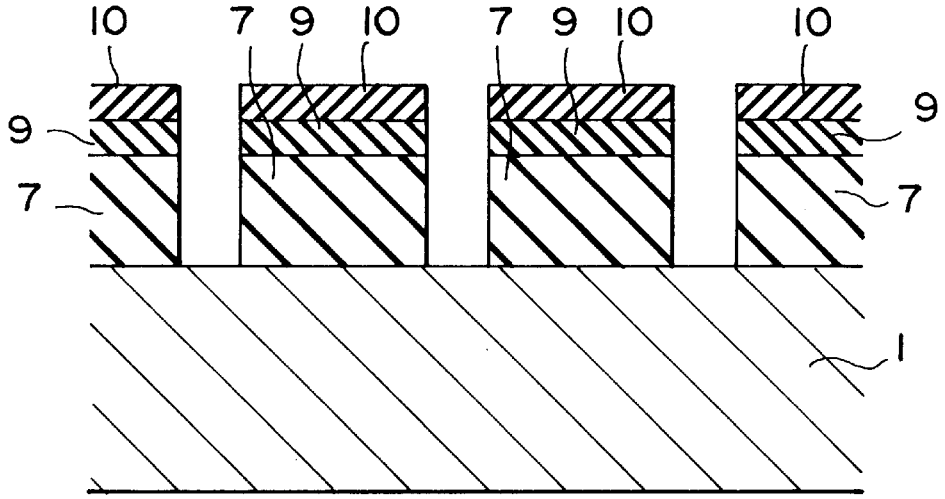

Then, as illustrated in FIG. 6B, the $SiO_2$ film 7 and the $Si_3N_4$ film 9 are locally removed by reactive ion etching with the photoresist film 10 used as a mask.

Figure 6C:
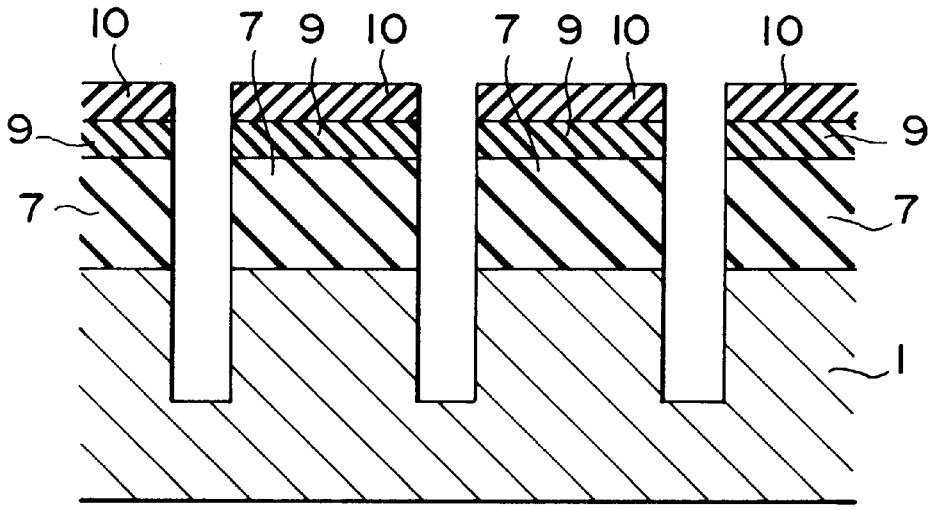

As illustrated in FIG. 6C, the n-type silicon substrate 1 is trenched by reactive ion etching with the photoresist film 10 used as a mask to form the grooves having a predetermined depth.

Figure 6D:
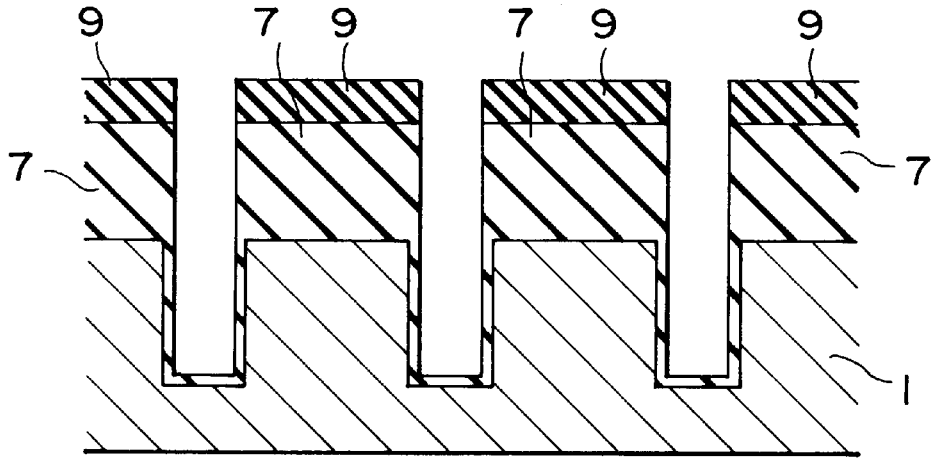

Thereafter, as illustrated in FIG. 6D, the photoresist film 10 is removed. Thereafter, an internal surface of each groove formed in the n-type silicon substrate 1 is lightly oxidized to form an oxide film having a thickness of about $500–10^{-8}$ cm.

Figure 6E:
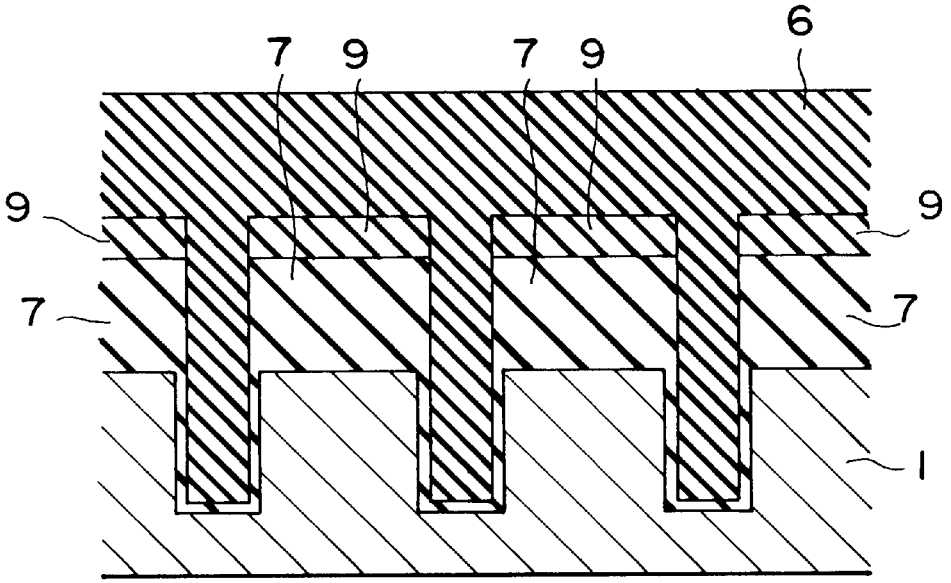

Then, as illustrated in FIG. 6E, the BPSG film 6 as an insulator film is grown thick on the $Si_3N_4$ film 9 by chemical vapor deposition (CVD) and fills the grooves formed in the n-type silicon substrate 1. By heat treatment, the BPSG film 6 is planarized through reflowing. Instead of the BPSG film 6, a polysilicon film may be used as the insulator film. For planarization, use may be made of a coating film. It is possible to improve the flatness by a combination of various planarization techniques.

Figure 6F:
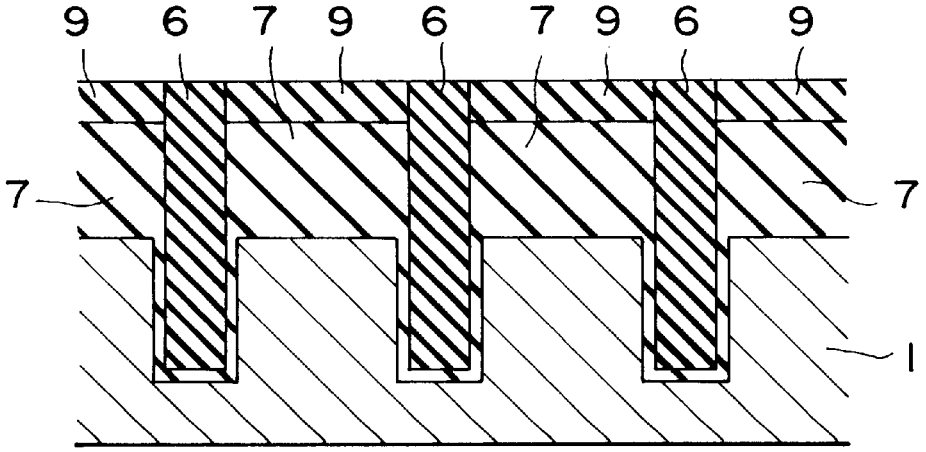

Next, as illustrated in FIG. 6F, the BPSG film 6 is etched back by reactive ion etching throughout its overall surface until the $Si_3N_4$ film 9 is exposed. Alternatively, the $Si_3N_4$ film 9 may be exposed by chemical mechanical polishing with an excellent flatness.

Figure 6G:
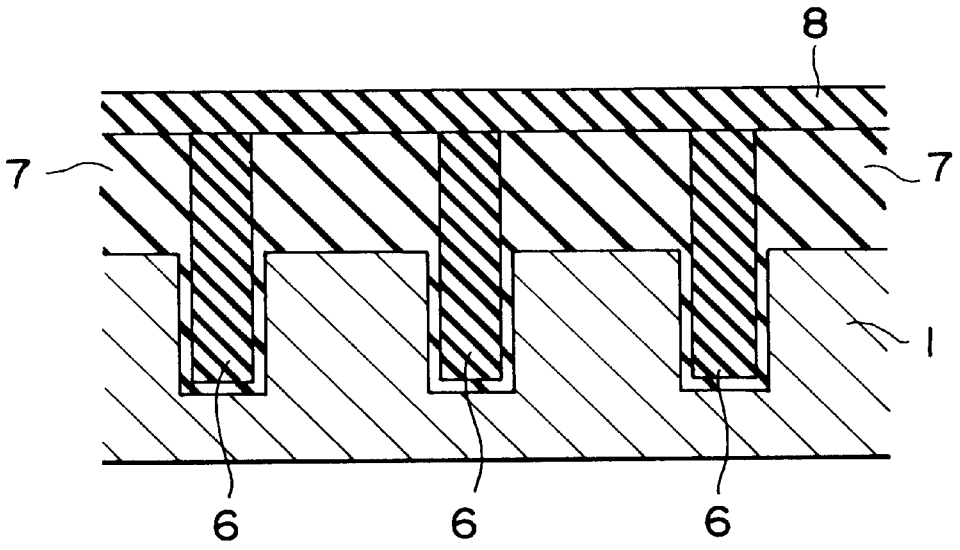

Then, the $Si_3N_4$ film 9 is removed together with a part of the BPSG film 6. Thereafter, as illustrated in FIG. 6G, the $Si_3N_4$ film 8 is deposited on an overall surface of the $SiO_2$ film 7 and the BPSG film 6 to a thickness of about $1500\times10^{-8}$ cm.

Figure 6H:
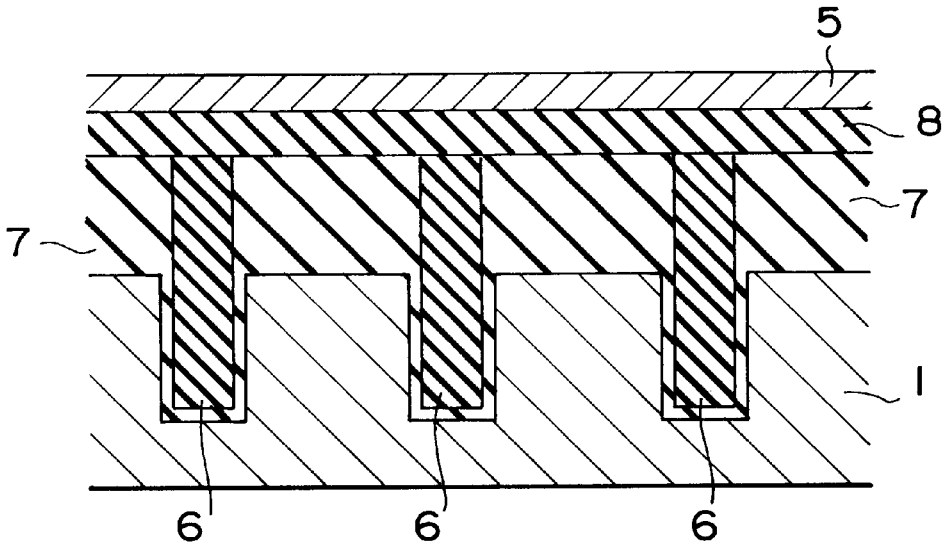
Figure 6I:
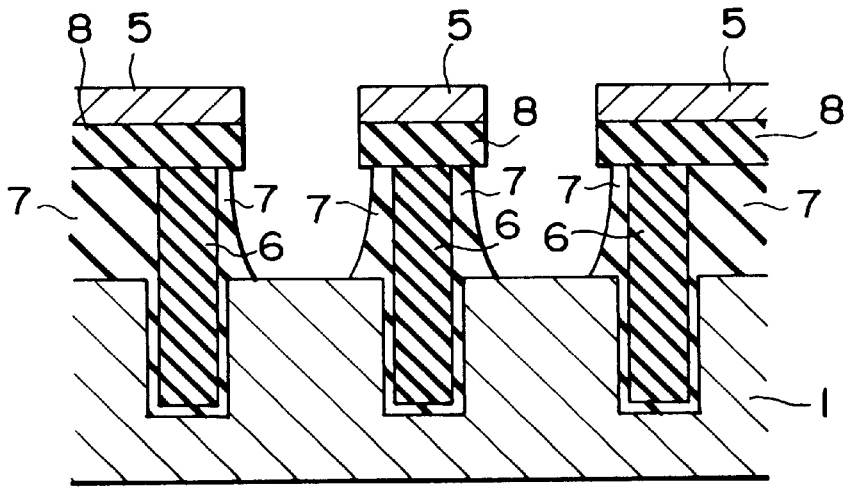

Subsequently, as illustrated in FIG. 6H, the gate electrode 5 is formed on the $Si_3N_4$ film 8 to a thickness of about $1500\times10^{-8}$ cm by sputtering a gate material. The gate material may be W, Mo, or $WSi_2$.

Thereafter, as illustrated in FIG. 61, the gate electrode 5, the $Si_3N_4$ film 8, and the $SiO_2$ film 7 are locally etched by the use of photolithography and reactive ion etching until the n-type silicon substrate 1 is exposed. In this manner, a plurality of small holes are formed through the gate electrode 5, the $Si_3N_4$ film 8, and the $SiO_2$ film 7.

Figure 6J:
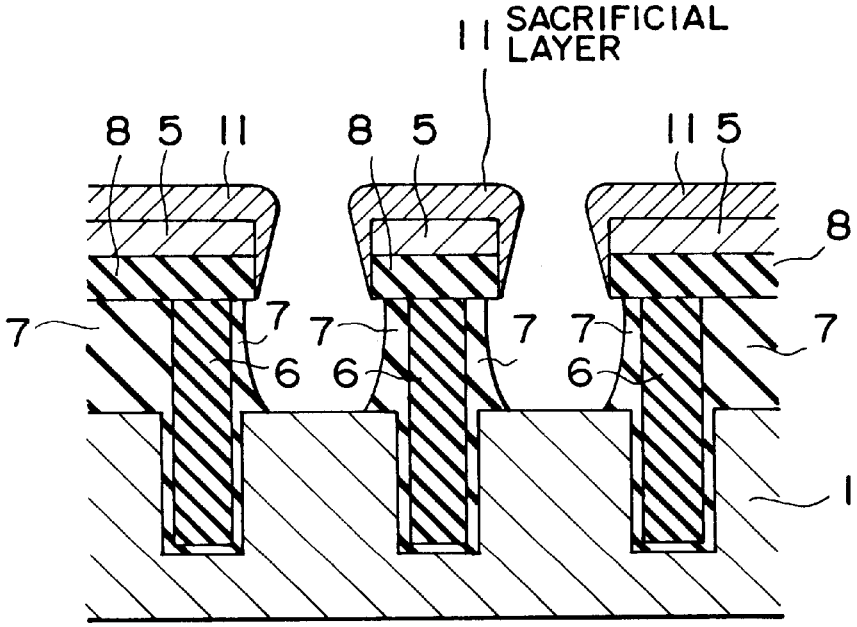

Then, as illustrated in FIG. 6J, rotary oblique deposition of a sacrificial layer material is carried out by the use of a vacuum deposition device. The sacrificial layer material is deposited on the gate electrode 5 and also adhered to side walls of the holes in the gate electrode 5 and the $Si_3N_4$ film 8 to form a sacrificial layer 11. It is noted here that the sacrificial layer 11 is essential to form the emitter cones 2 of a Spindt type as will later be described, and is removed in a later process. The sacrificial layer 11 may be formed of a material such as MgO, Al, and AlO.

Figure 6K:
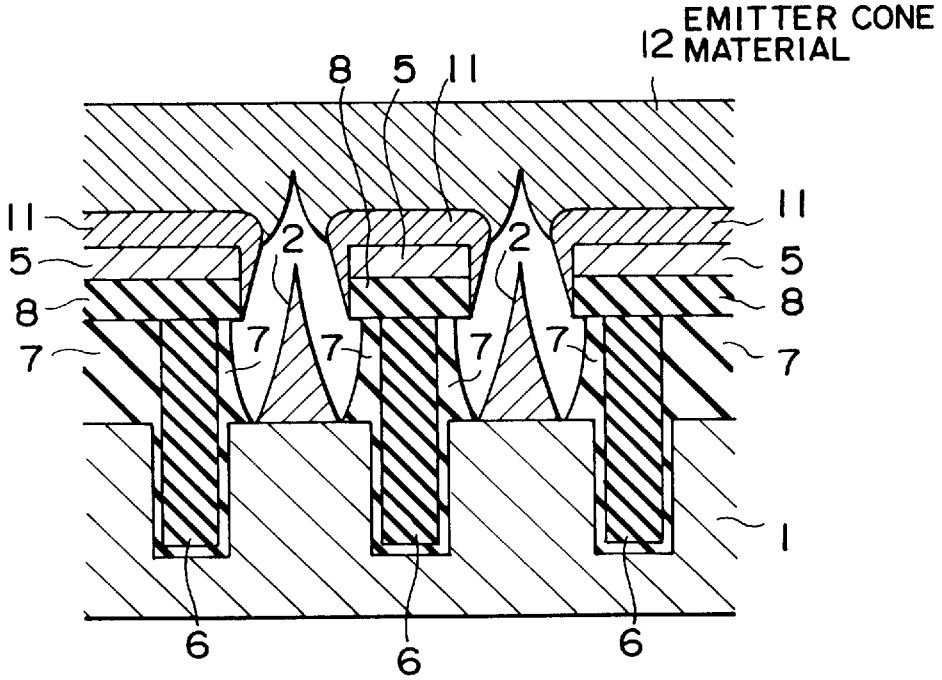

Subsequently, an emitter cone material 12 is deposited on the n-type silicon substrate 1 in a direction perpendicular thereto. In this event, the emitter cone material 12 is partially adhered to the side walls of the holes in the gate electrode 5 to narrow the holes. Such narrowing of the holes is reflected to the deposition of the emitter cone material 12 in the insulator holes. As a consequence, as illustrated in FIG. 6K, the emitter cones 2 of a Spindt type are formed. The emitter cone material 12 may be Mo, TiC, ZrC, Ni, TiN, or ZrN.

Figure 6L:
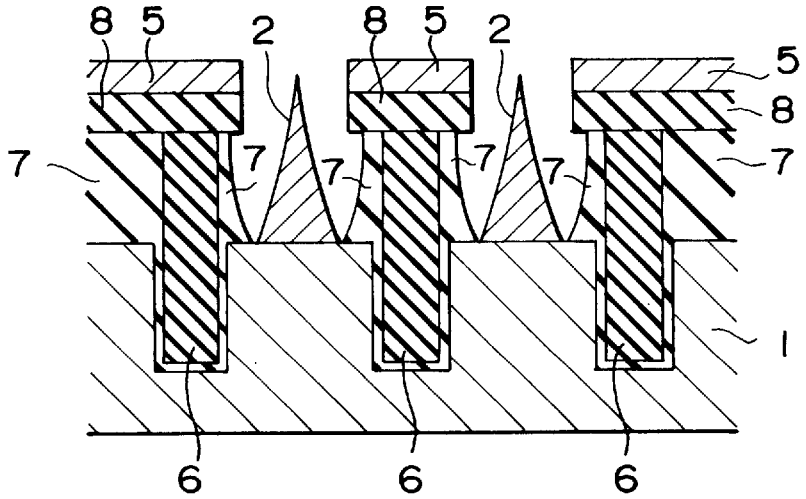

Finally, the sacrificial layer 11 is etched to lift off the emitter cone material 12 left on the sacrificial layer 11 in the preceding step. If the sacrificial layer 11 is formed of MgO, acetic acid is used in etching. If the sacrificial layer 11 is formed of Al, phosphoric acid is used in etching. In this manner, the field emission cold cathode of the first embodiment is obtained as illustrated in FIG. 6L.

In the above-mentioned steps, specific numerical values (such as film thicknesses) are recited for a better understanding of this invention. However, this invention is not restricted to these conditions described in this embodiment.

Second Embodiment

Figure 7:
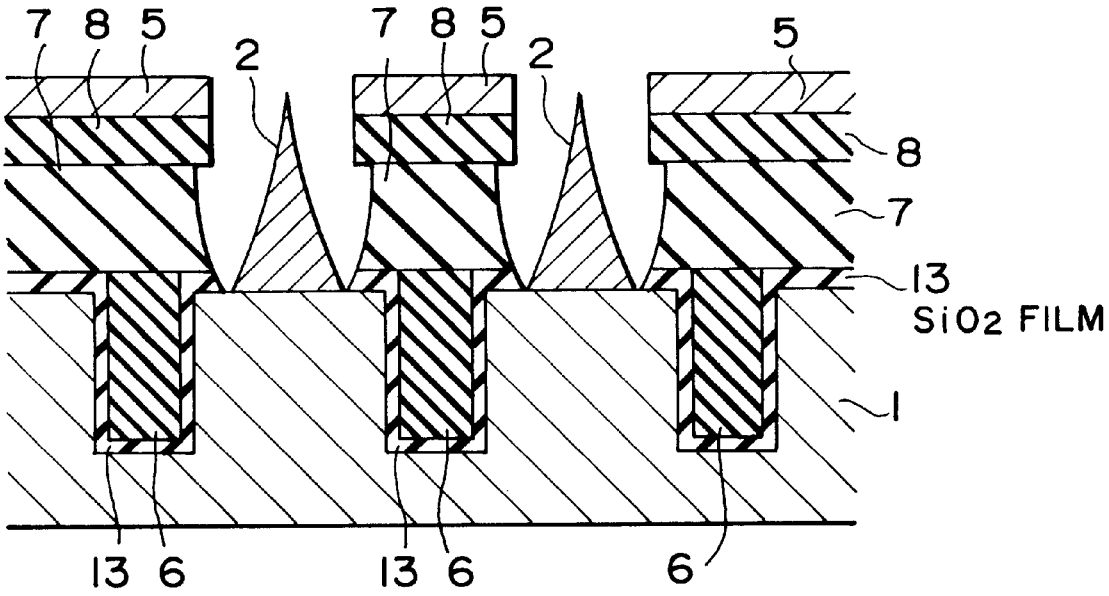
FIG. 7 is a sectional view of a field emission cold cathode according to a second embodiment of this invention.

Referring to FIG. 7, a field emission cold cathode according to a second embodiment of this invention comprises an n-type silicon substrate 1, a plurality of emitter cones 2, a gate electrode 5, a BPSG film 6, an $SiO_2$ film 13, an $SiO_2$ film 7, and an $Si_3N_4$ film 8.

In this embodiment, the buried insulator layer 3 in FIG. 4 is composed of the BPSG film 6 filled in a plurality of grooves formed in the n-type silicon substrate 1 and the $SiO_2$ film 13.

The field emission cold cathode of this embodiment is capable of preventing continuous discharge as described above.

Next referring to FIGS. 8A through 8L, description will be made about a process of manufacturing the field emission cold cathode of the second embodiment.

Figure 8A:
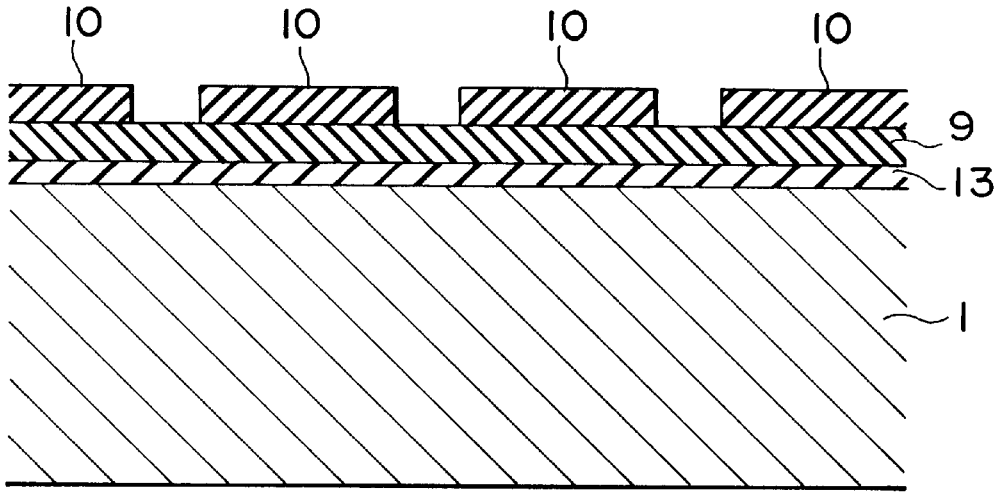
FIGS. 8A through 8L are views for describing a manufacturing process of the field emission cold cathode illustrated in FIG. 7.

As illustrated in FIG. 8A, the $SiO_2$ film 13 and and $Si_3N_4$ film 9 are successively deposited on the n-type silicon substrate 1 to thicknesses of about $500\times10^{-8}$ cm and about $1500\times10^{-8}$, respectively. Then, on the $Si_3N_4$ film 9, a photoresist film 10 is applied except those regions above predetermined positions where the grooves are later formed in the n-type silicon substrate 1.

Figure 8B:
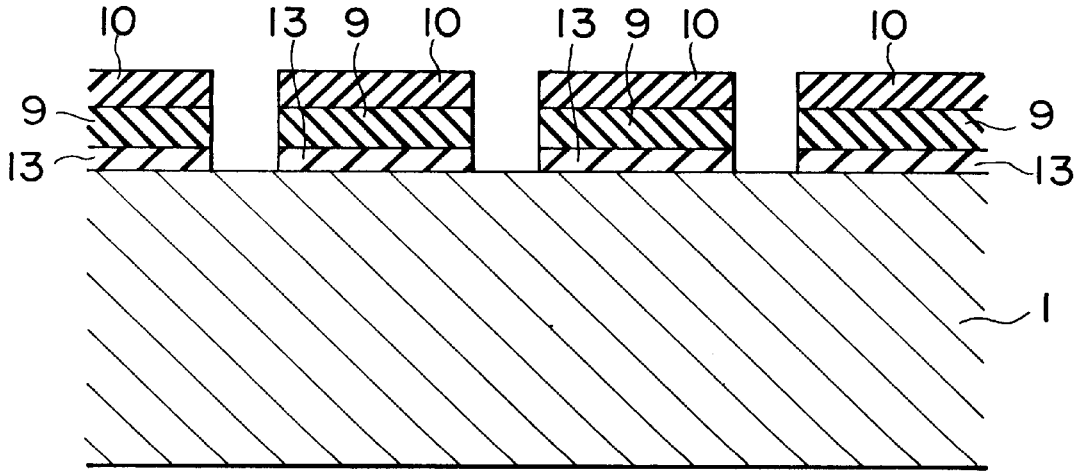

Then, as illustrated in FIG. 8B, the $SiO_2$ film 13 and the $Si_3N_4$ film 9 are locally removed by reactive ion etching with the photoresist film 10 used as a mask.

Figure 8C:
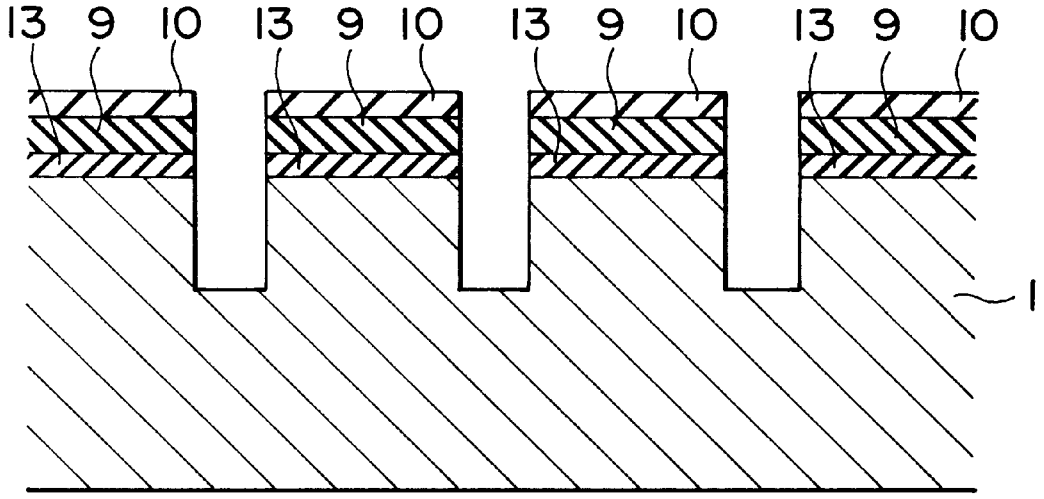

As illustrated in FIG. 8C, the n-type silicon substrate 1 is trenched by reactive ion etching with the photoresist film 10 used as a mask to form the grooves having a predetermined depth.

Figure 8D:
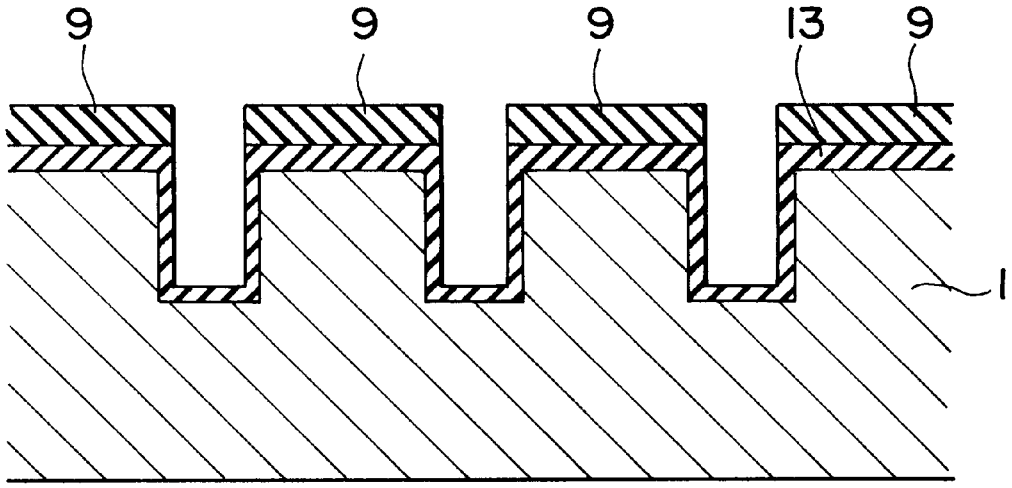

Thereafter, as illustrated in FIG. 8D, the photoresist film 10 is removed. Thereafter, an internal surface of each groove formed in the n-type silicon substrate 1 is lightly oxidized to form an oxide film having a thickness of about $500\times10^{-8}$ cm.

Figure 8E:
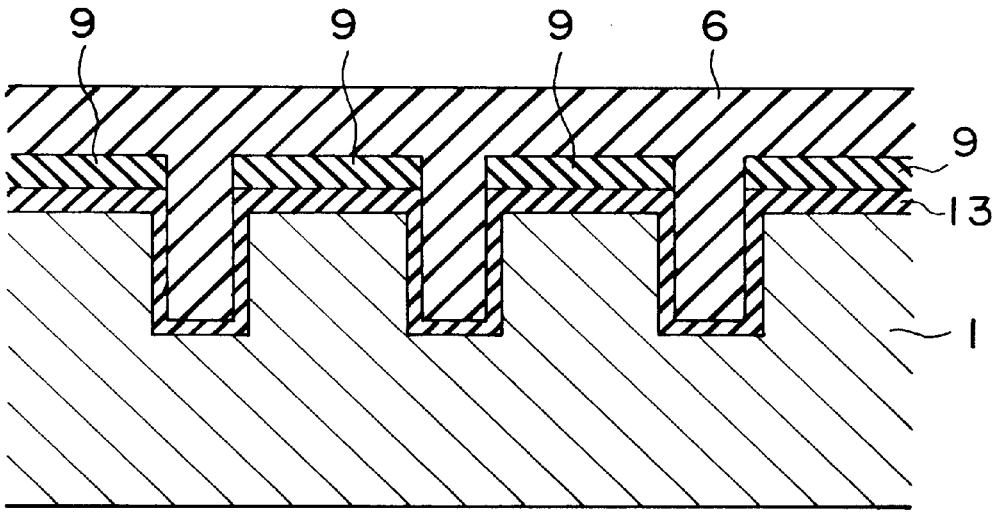

Then, as illustrated in FIG. 8E, the BPSG film 6 as an insulator film is grown thick on the $Si_3N_4$ film 9 by chemical vapor deposition (CVD) and fills the grooves formed in the n-type silicon substrate 1. By heat treatment, the BPSG film 6 is planarized through reflowing. Instead of the BPSG film 6, a polysilicon film may be used as the insulator film. For planarization, use may be made of a coating film. It is possible to improve the flatness by a combination of various planarization techniques.

Figure 8F:
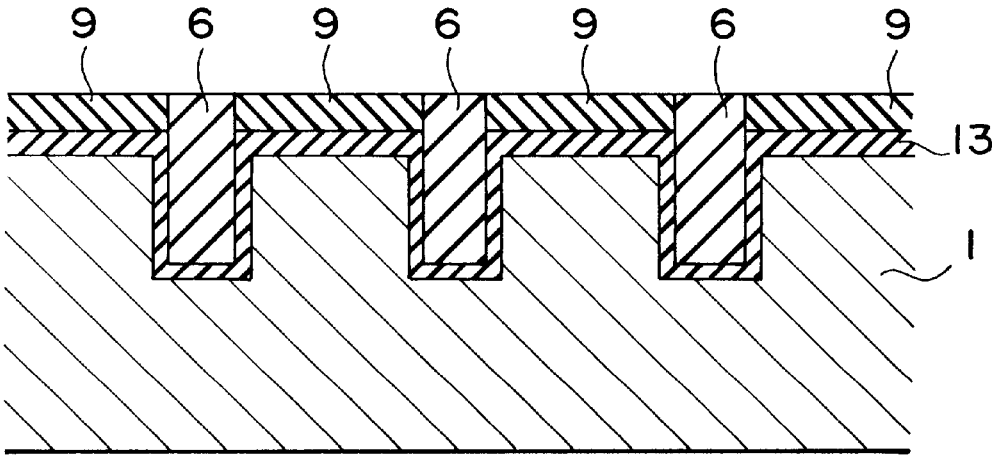

Next, as illustrated in FIG. 8F, the BPSG film 6 is etched back by reactive ion etching throughout its overall surface until the $Si_3N_4$ film 9 is exposed. Alternatively, the $Si_3N_4$ film 9 may be exposed by chemical mechanical polishing with an excellent flatness.

Figure 8G:
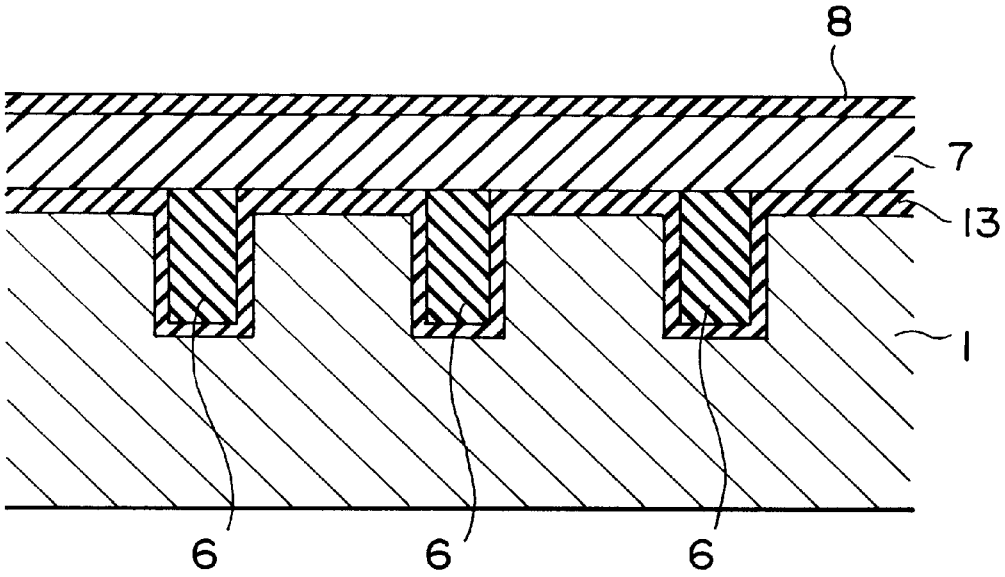

Then, the $Si_3N_4$ film 9 is removed together with a part of the BPSG film 6. Thereafter, as illustrated in FIG. 8G, the $SiO_2$ film 7 and the $Si_3N_4$ film 8 are successively deposited on an overall surface of the $SiO_2$ film 13 and the BPSG film 6 to thicknesses of about $5000\times10^{-8}$ cm and $1500\times10^{8}$ cm, respectively.

Figure 8H:
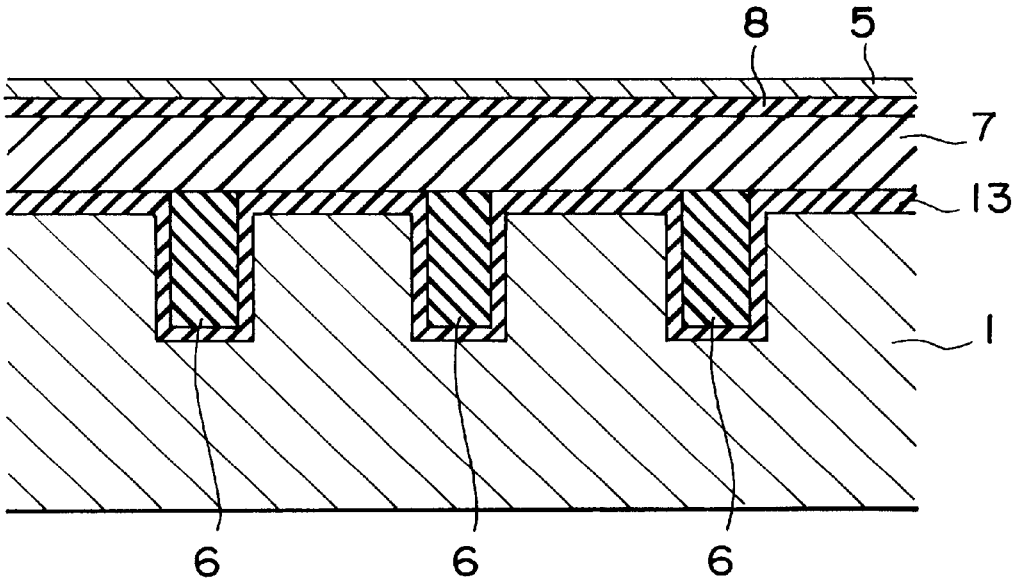

Subsequently, as illustrated in FIG. 8H, the gate electrode 5 is formed on the $Si_3N_4$ film 8 to a thickness of about $1500\times10^{-8}$ cm by sputtering a gate material. The gate material may be W, Mo, or $WSi_2$.

The subsequent steps are similar to those described in conjunction with the first embodiment.

Figure 8I:
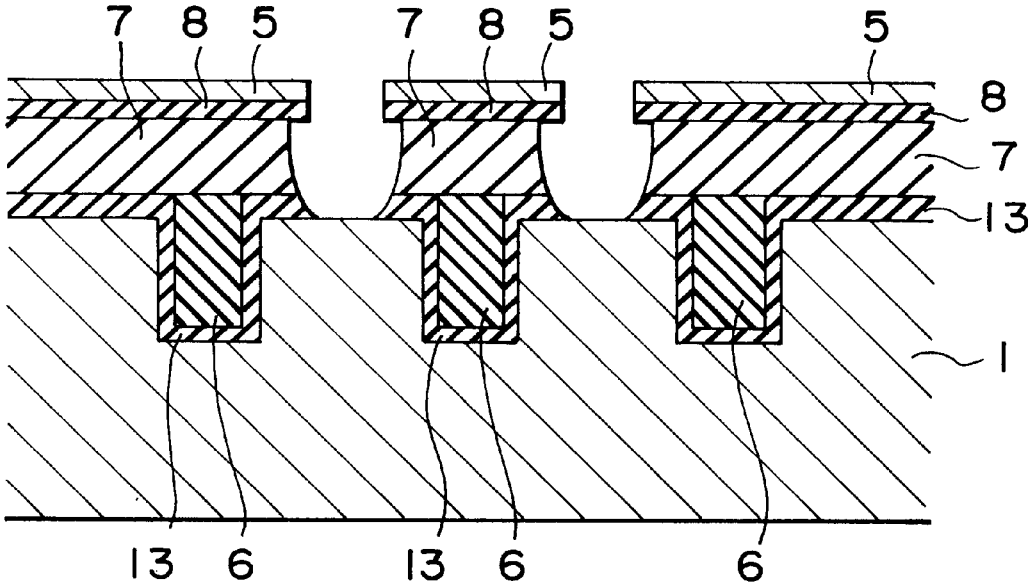

Specifically, as illustrated in FIG. 8I, the gate electrode 5, the $Si_3N_4$ film 8, the $SiO_2$ film 7, and the $SiO_2$ film 13 are locally etched by the use of photolithography and reactive ion etching until the n-type silicon substrate 1 is exposed. In this manner, a plurality of small holes are formed through the gate electrode 5, the $Si_3N_4$ film 8, the $SiO_2$ film 7, and the $SiO_2$ film 13.

Figure 8J:
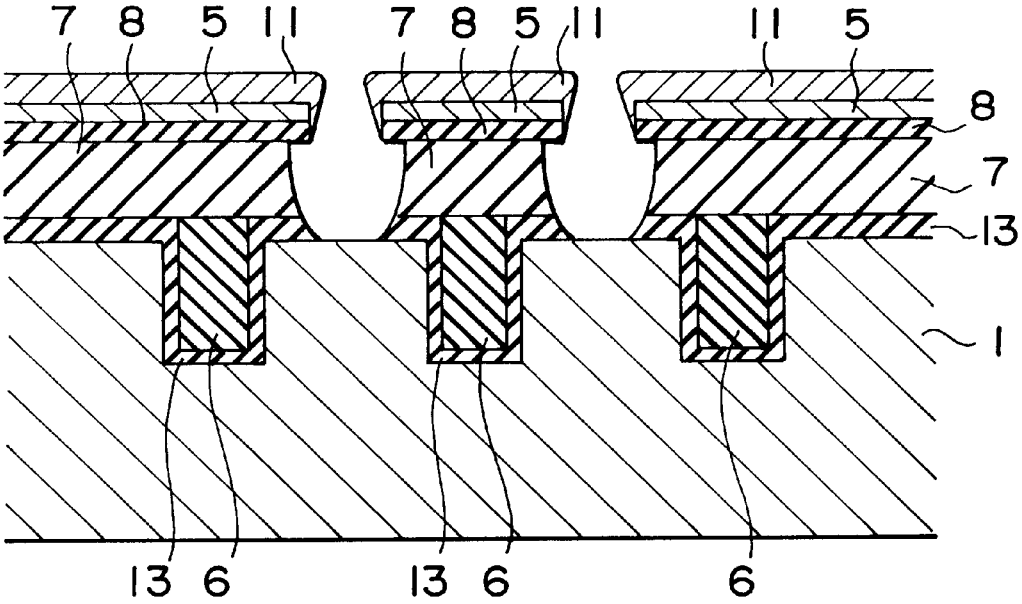

Then, as illustrated in FIG. 8J, rotary oblique deposition of a sacrificial layer material is carried out by the use of a vacuum deposition device. The sacrificial layer material is deposited on the gate electrode 5 and also adhered to the side walls of the holes in the gate electrode 5 and the $Si_3N_4$ film 8 to form a sacrificial layer 11. The sacrificial layer 11 may be formed of the material such as MgO, Al, and AlO, as described in conjunction with the first embodiment.

Figure 8K:
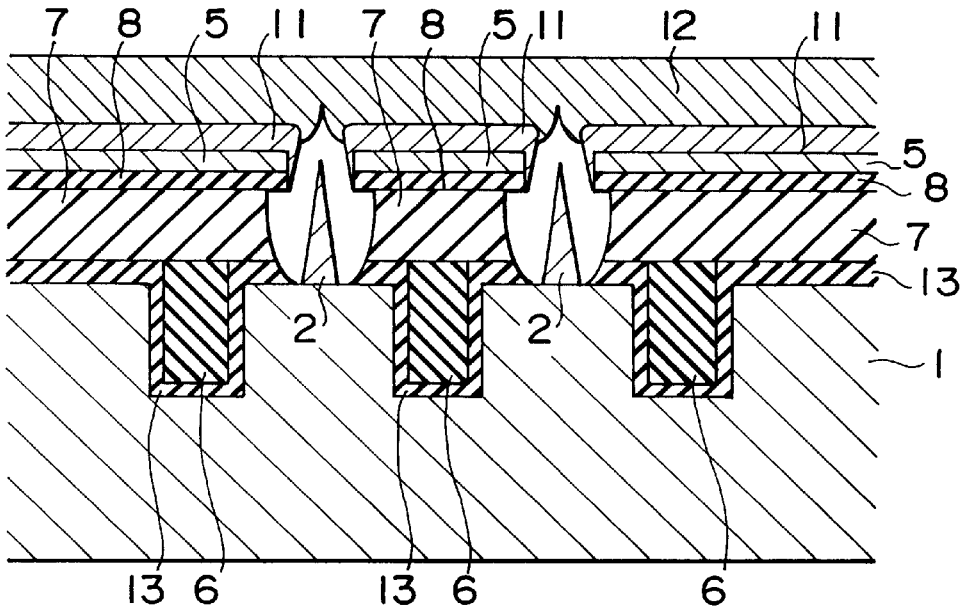

Subsequently, an emitter cone material 12 is deposited on the n-type silicon substrate 1 in a direction perpendicular thereto. As a consequence, as illustrated in FIG. 8K, the emitter cones 2 of a Spindt type are formed. The emitter cone material 12 may be Mo, TiC, ZrC, Ni, TiN, or ZrN, as described in conjunction with the first embodiment.

Figure 8L:
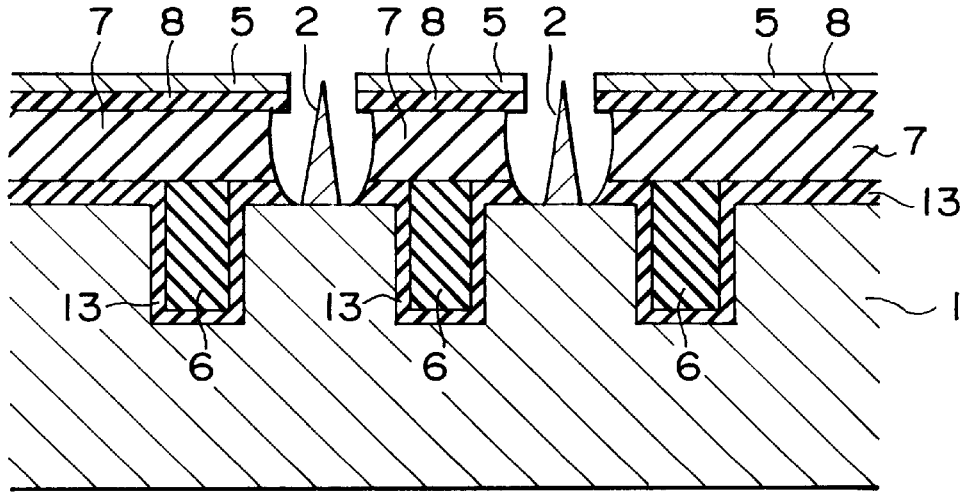

Finally, the sacrificial layer 11 is etched to lift off the emitter cone material 12 left on the sacrificial layer 11 in the preceding step. In this manner, the field emission cold cathode of the second embodiment is obtained as illustrated in FIG. 8L.

In the above-mentioned steps, specific numerical values are recited for convenience of description. However, this invention is not restricted to those conditions described in this embodiment.

Third Embodiment

Figure 9:
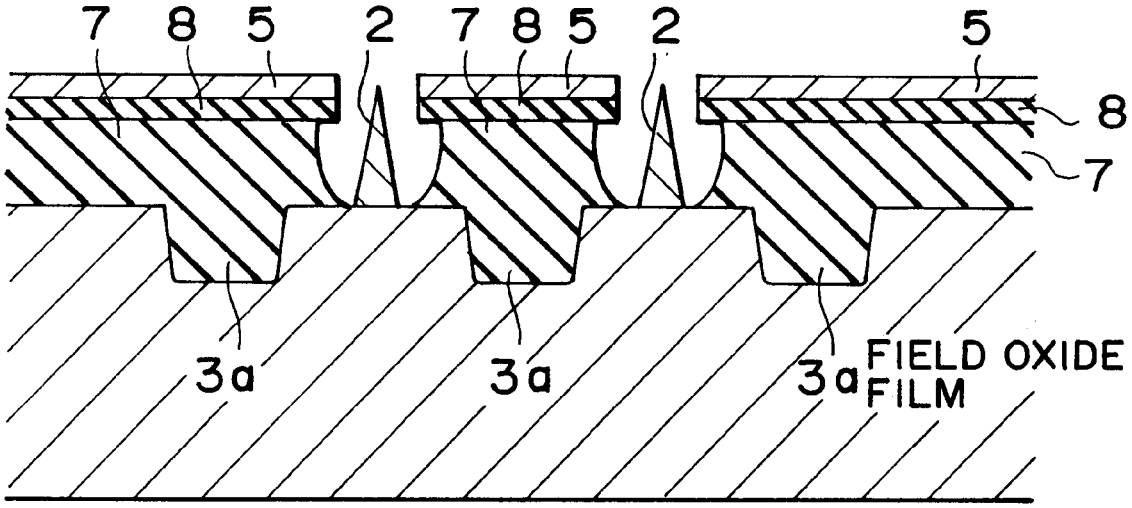
FIG. 9 is a sectional view of a field emission cold cathode according to a third embodiment of this invention.

Referring to FIG. 9, a field emission cold cathode according to a third embodiment of this invention comprises an n-type silicon substrate 1, a plurality of emitter cones 2, a field oxide film 3a surrounding underlying regions right under the emitter cones 2, an $SiO_2$ film 7, an $Si_3N_4$ film 8, and a gate electrode 5.

In this embodiment, the buried insulator layer 3 in FIG. 4 comprises the field oxide film 3*a* formed by the use of a process of local oxidation of silicon (LOCOS), namely, a LOCOS process, as will later be described.

The field emission cold cathode of this embodiment is capable of preventing continuous discharge as described above without suffering the problems in the second and the third conventional devices.

Next referring to FIGS. 10A through 10J, description will be made about a process of manufacturing the field emission cold cathode of the third embodiment.

Figure 10A:
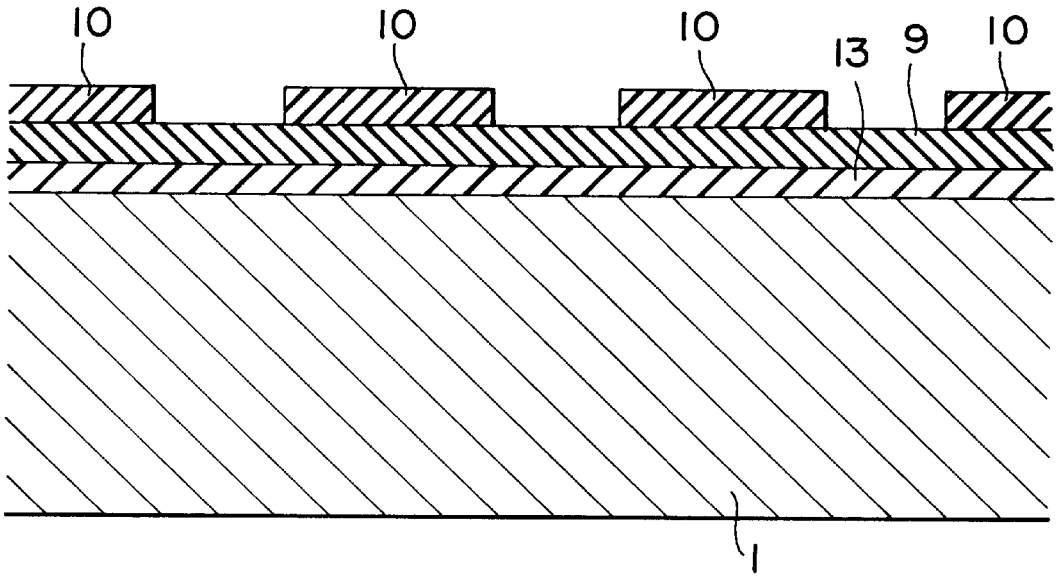
FIGS. 10A through 10J are views for describing a manufacturing process of the field emission cold cathode illustrated in FIG. 9.

As illustrated in FIG. 10A, the $SiO_2$ film 13 and an $Si_3N_4$ film 9 are successively deposited on the n-type silicon substrate 1 to thicknesses of about $500\times10^{-8}$ cm and about $1500\times10^{-8}$ cm, respectively. Then, on the $Si_3N_4$ film 9, a photoresist film 10 is applied except those regions above predetermined positions where the field oxide film 3*a* is later formed in the n-type silicon substrate 1.

Figure 10B:
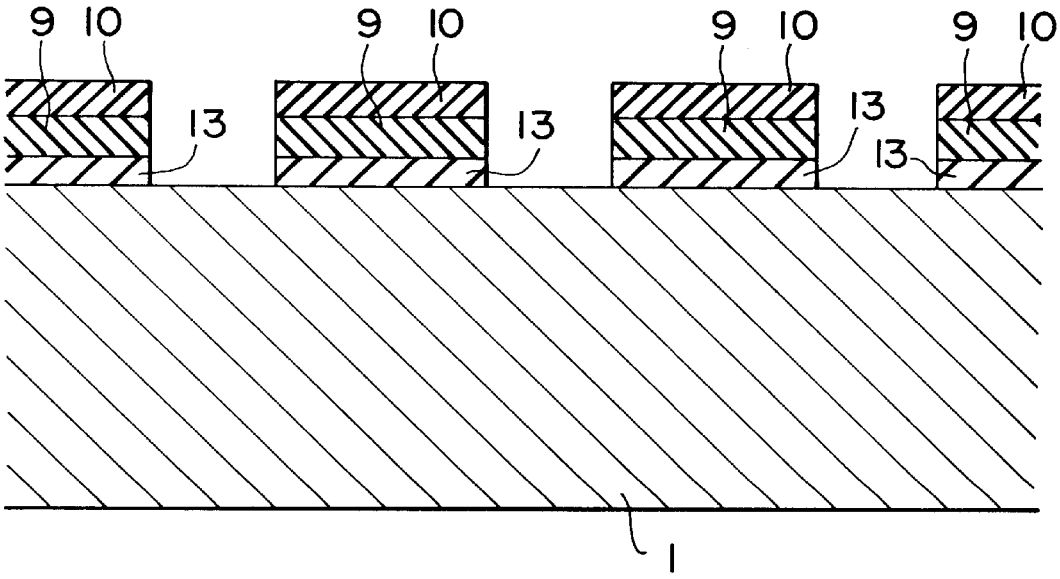

Then, as illustrated in FIG. 10B, the $SiO_2$ film 13 and the $Si_3N_4$ film 9 are locally removed by reactive ion etching with the photoresist film 10 used as a mask.

Figure 10C:
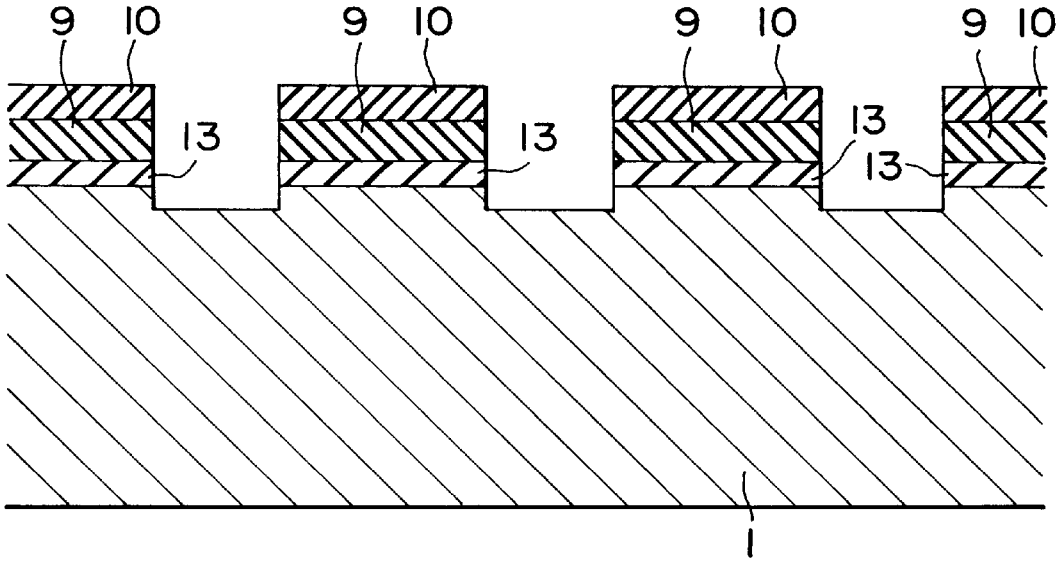

As illustrated in FIG. 10C, the n-type silicon substrate 1 is recessed by reactive ion etching with the photoresist film 10 used as a mask to form a plurality of grooves having a predetermined depth. In this embodiment, the predetermined depth is determined so that the field oxide film 3*a* fills removed portions of the $SiO_2$ film 13 to form a flat surface throughout the field oxide film 3*a* and the $SiO_2$ film 13. It is noted here that, when the field oxide film 3*a* is formed by oxidation in a later step, the field oxide film 3*a* is grown on and under the bottom of each groove. The upper part of the field oxide film 3*a* corresponds to 55% of the total thickness of the field oxide film 3*a*.

Figure 10D:
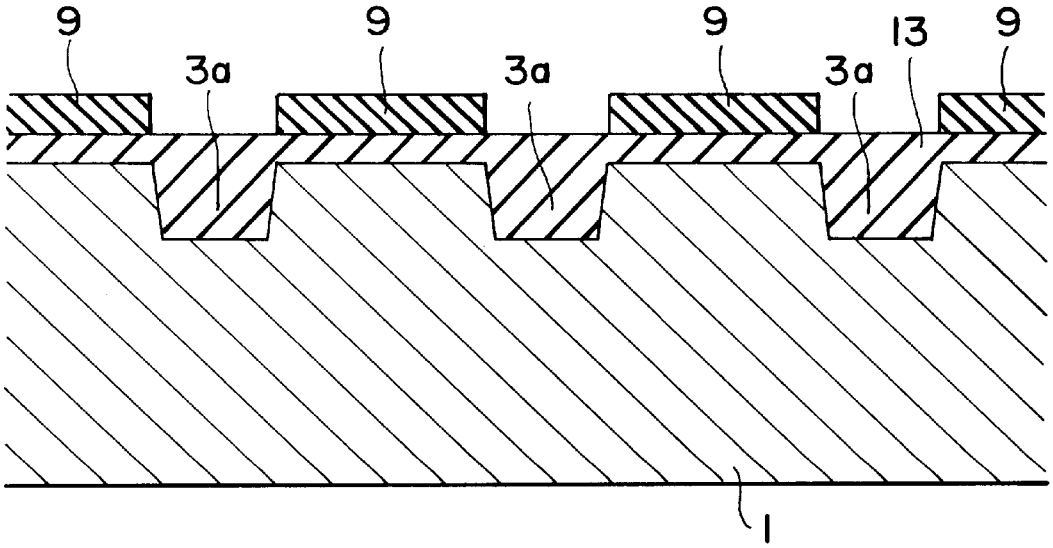

Thereafter, as illustrated in FIG. 10D, the photoresist film 10 is removed and the field oxide film 3*a* is formed with the $Si_3N_4$ film 9 used as a mask. The field oxide film 3*a* has a total thickness of about 1 $\mu$m. As described above, the field oxide film 3*a* is grown on and under the bottom of the each groove. An uppermost part of the field oxide film 3*a* is continuous to the $SiO_2$ film 13 and therefore illustrated in the figure as a part of the $SiO_2$ film 13.

Figure 10E:
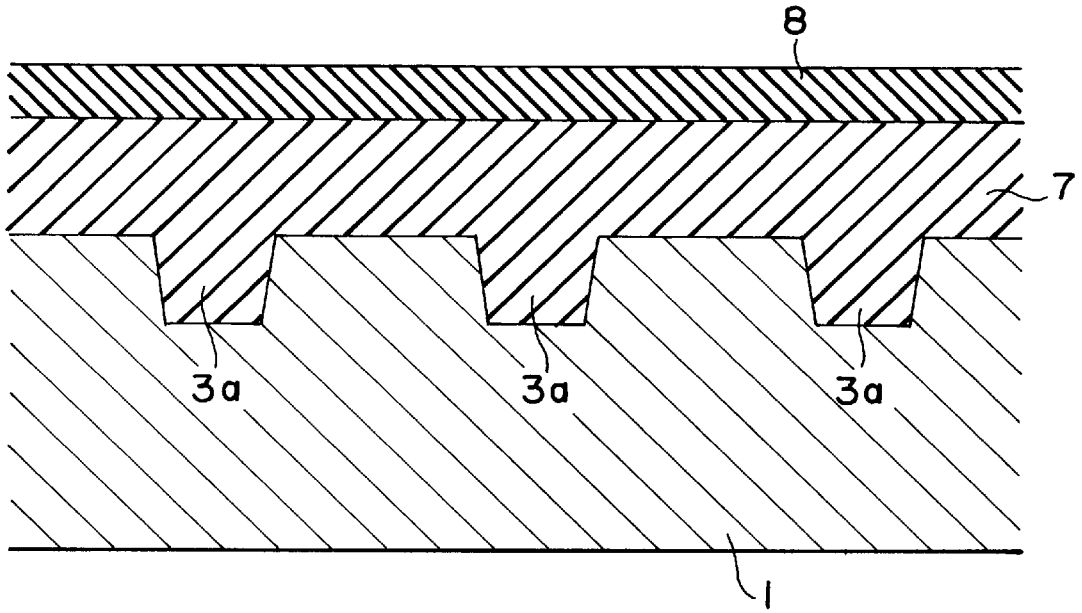

Then, as illustrated in FIG. 10E, the $Si_3N_4$ film 9 is removed with the $SiO_2$ film 13 left. Thereafter, a $SiO_2$ film is deposited on the $SiO_2$ film 13 to form a combined $SiO_2$ film depicted by 7 in FIG. 10E. Next, the $Si_3N_4$ film 8 is deposited on an overall surface of the combined $SiO_2$ film 7. In the illustrated example, the combined $SiO_2$ film 7 and the $Si_3N_4$ film 8 have thicknesses of about $5000\times10^{-8}$ cm and $1500\times10^{-8}$ cm, respectively.

Figure 10F:
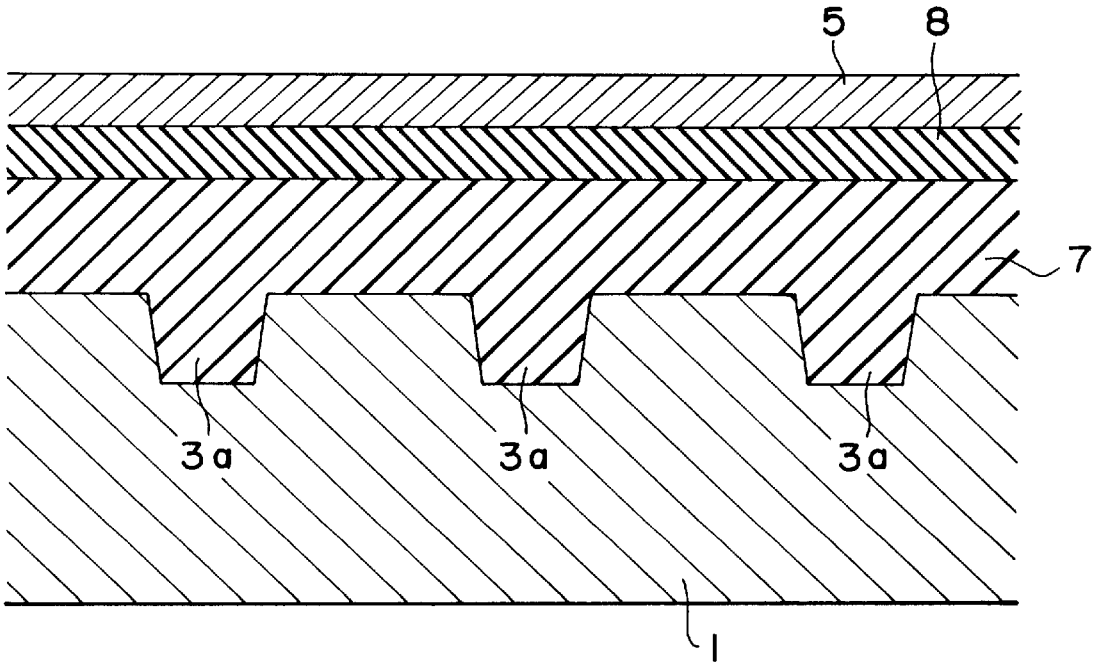

Subsequently, as illustrated in FIG. 10F, the gate electrode 5 is formed on the $Si_3N_4$ film 8 to a thickness of about $1500\times10^{-8}$ cm by sputtering a gate material. The gate material may be W, Mo, or $WSi_2$.

The subsequent steps are similar to those described in conjunction with the first embodiment.

Figure 10G:
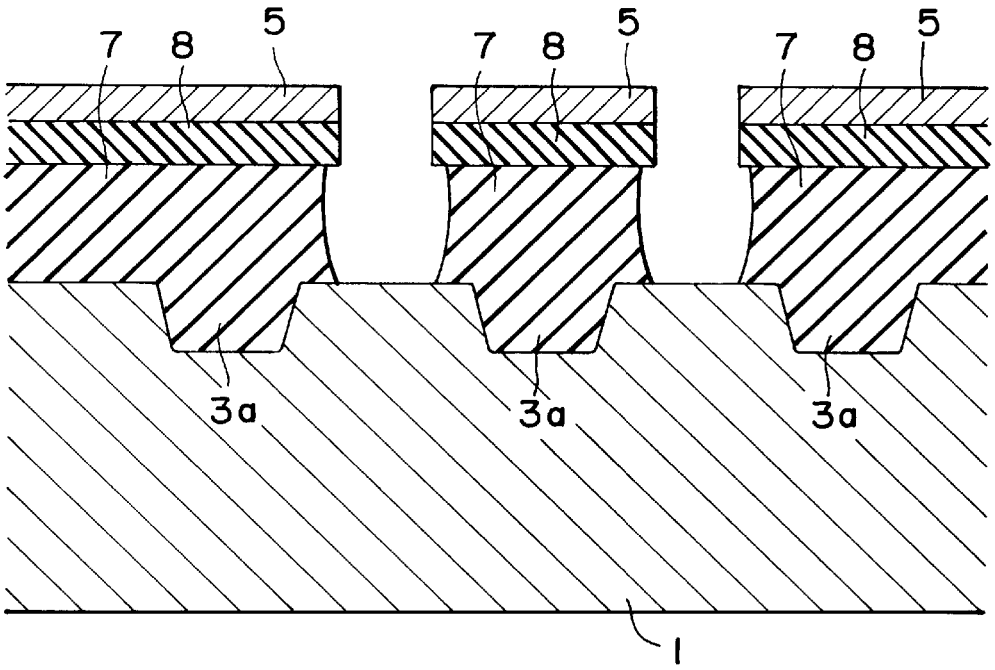

Specifically, as illustrated in FIG. 10G, the gate electrode 5, the $Si_3N_4$ film 8, and the $SiO_2$ film 7 are locally etched by the use of photolithography and reactive ion etching until the n-type silicon substrate 1 is exposed. In this manner, a plurality of small holes are formed.

Figure 10H:
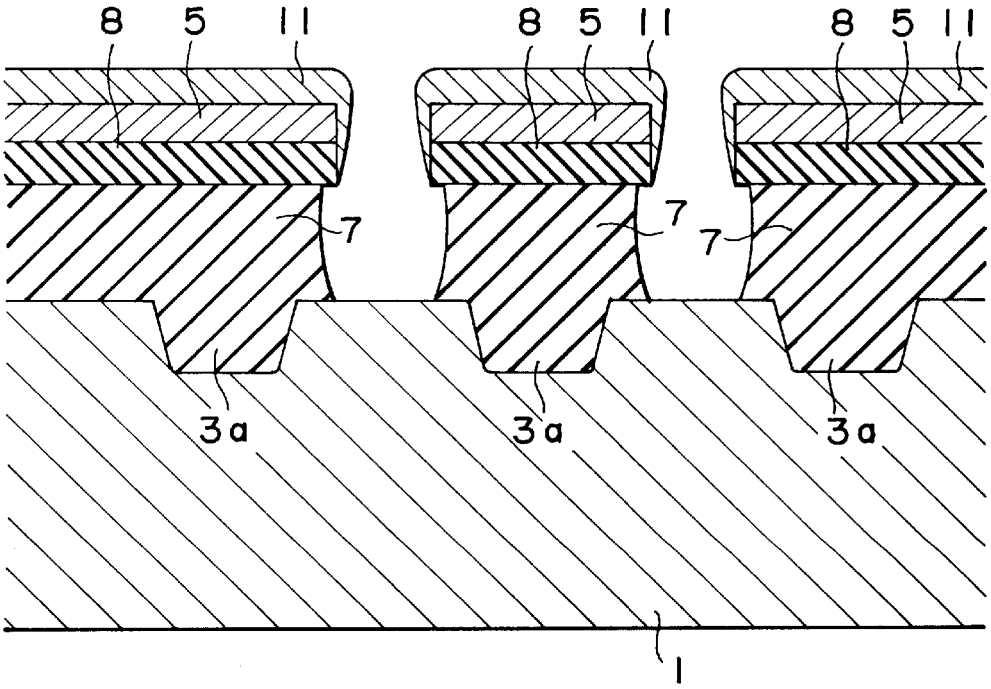

Then, as illustrated in FIG. 10H, rotary oblique deposition of a sacrificial layer material is carried out by the use of a vacuum deposition device. The sacrificial layer material is deposited on the gate electrode 5 and also adhered to the side walls of the holes in the gate electrode 5 and the $Si_3N_4$ film 8 to form a sacrificial layer 11. The sacrificial layer 11 may be formed of the material such as MgO, Al, and AlO, as described in conjunction with the first embodiment.

Figure 10I:
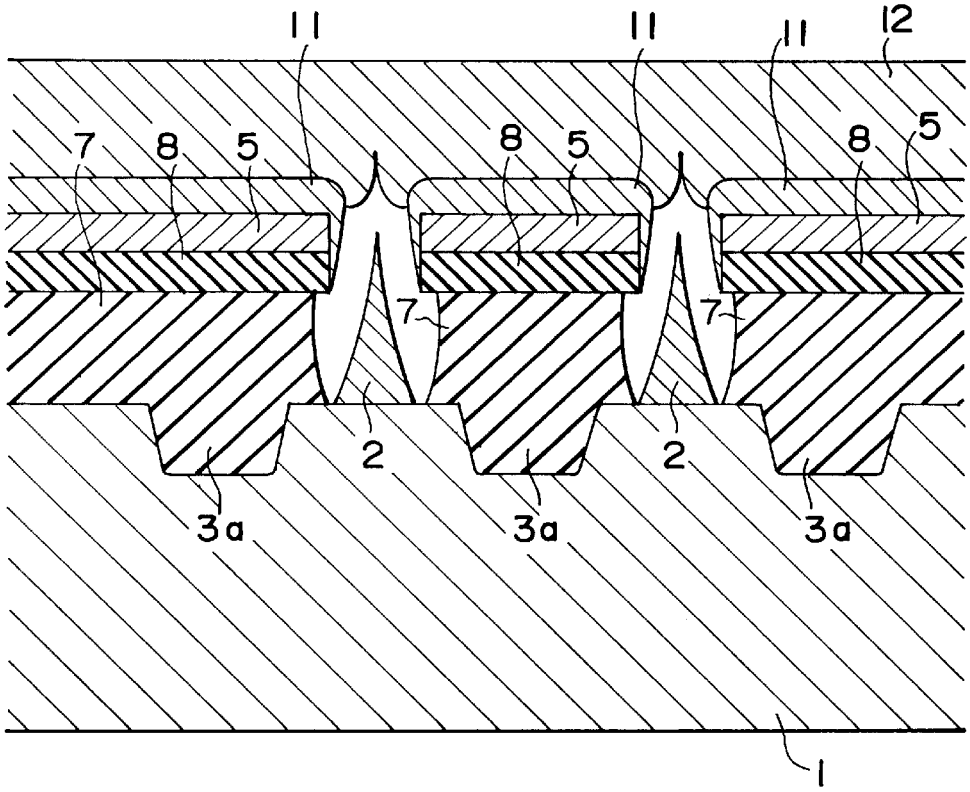

Subsequently, an emitter cone material 12 is deposited on the n-type silicon substrate 1 in a direction perpendicular thereto. As a consequence, as illustrated in FIG. 10I, the emitter cones 2 of a Spindt type are formed. The emitter cone material 12 may be Mo, TiC, ZrC, Ni, TiN, or ZrN, as described in conjunction with the first embodiment.

Figure 10J:
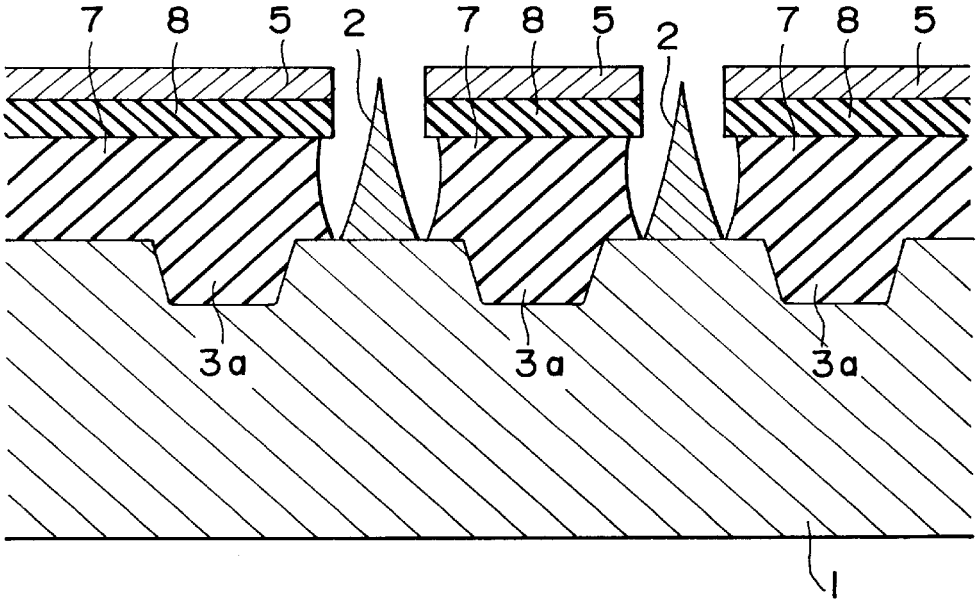

Finally, the sacrificial layer 11 is etched to lift off the emitter cone material 12 left on the sacrificial layer 11 in the preceding step. In this manner, the field emission cold cathode of the third embodiment is obtained as illustrated in FIG. 10J.

In the above-mentioned steps, specific numerical values are recited for convenience of description. However, this invention is not restricted to those conditions described in this embodiment.

In the field emission cold cathode of the third embodiment, the depth of the field oxide film 3*a* as the buried insulator layer 3 can not be as deep as those of the first and the second embodiments because of the nature of the process. However, the process described in the third embodiment is simple as compared with those described in conjunction with the first and the second embodiments.

Therefore, selection of the first, the second, and the third embodiments is optional and can be determined in dependence upon the desired depth of the buried insulator layer 3.

Fourth Embodiment

Figure 11:
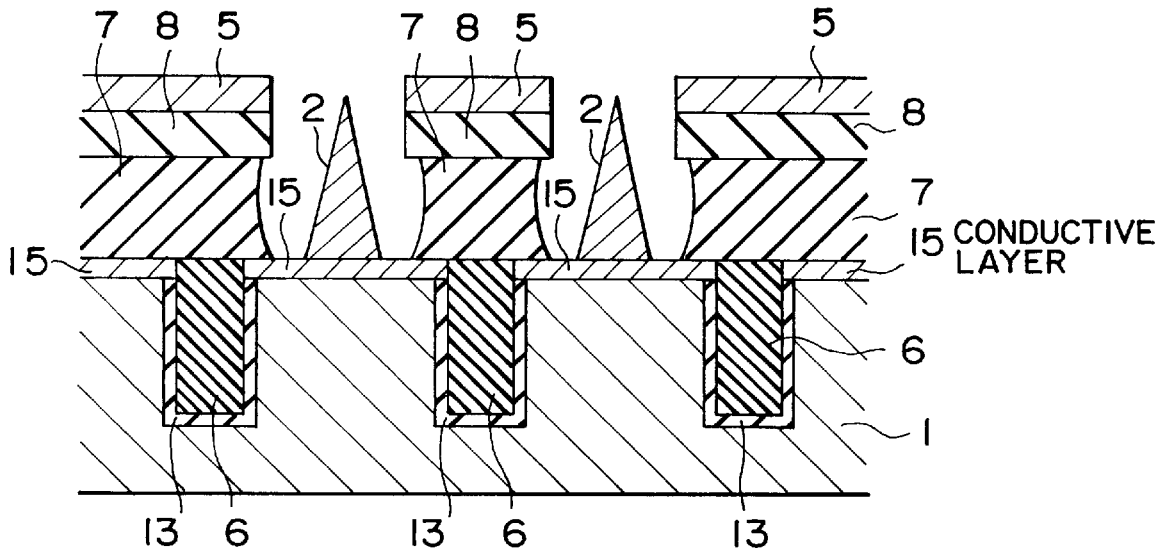
FIG. 11 shows a sectional view of a field emission cold cathode according to a fourth embodiment of this invention.

Referring to FIG. 11, a field emission cold cathode according to a fourth embodiment of this invention comprises an n-type silicon substrate 1, a conductive layer 15, a plurality of emitter cones 2, a gate electrode 5, a BPSG film 6, an $SiO_2$ film 13, an $SiO_2$ film 7, and an $Si_3N_4$ film 8.

Herein, the buried insulator layer 3 in FIG. 4 is composed of the BPSG film 6 filled in a plurality of grooves formed in the n-type silicon substrate 1 and the $SiO_2$ film 13. The buried insulator layer 3 is formed in the n-type silicon substrate 1 to surround underlying regions of the n-type silicon substrate 1 right under the emitter cones 2.

The conductive layer 15 is formed on the n-type silicon substrate 1 to be separated by the buried insulator layer 3 into a plurality of conductive layer portions. Each of the emitter cones 2 is formed on the conductive layer 15 in each of the conductive layer portions. Specifically, the conductive layer 15 is interposed between the bottom of each of the emitter cones 2 and the n-type silicon substrate 1.

As described above, the field emission cold cathode of this embodiment further comprises the conductive layer 15 in contact with the n-type silicon substrate 1 over a large contact area. Therefore, the contact resistance is kept stable at a small resistance value. Both of the emitter cones 2 and the conductive layer 15 are formed by a metal material. Therefore, even if the bottom area of each emitter cone 2 is reduced following the development of the semiconductor technology, it is possible to avoid an increase of contact resistance described in conjunction with the first and the fifth conventional devices. Thus, the field emission cold cathode of this embodiment keeps a stable resistance value with respect to the n-type silicon substrate 1 right under the emitter cones 2 through the conductive layer 15. Therefore, the field emission cold cathode of this embodiment keeps an excellent electron emission characteristic and is still capable of preventing continuous discharge as described in conjunction with the second embodiment.

Next referring to FIGS. 12A through 12L, description will be made about a process of manufacturing the field emission cold cathode of the fourth embodiment.

Figure 12A:
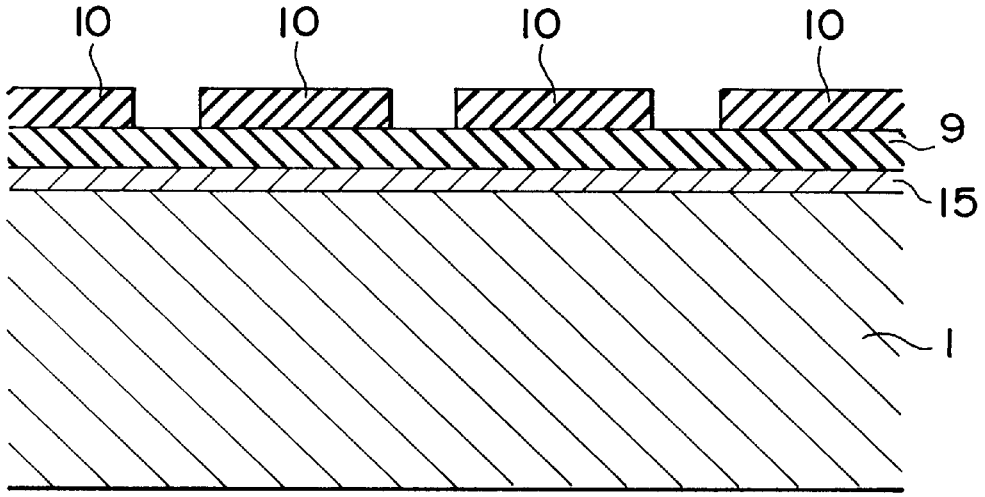
FIGS. 12A through 12L are views for describing a manufacturing process of the field emission cold cathode illustrated in FIG. 11.

As illustrated in FIG. 12A, the conductive layer 15 and an $Si_3N_4$ film 9 are successively deposited on the n-type silicon substrate 1 to thicknesses of about $1500\times10^{-8}$ cm and about $1500\times10^{-8}$ cm, respectively. Then, on the $Si_3N_4$ film 9, a photoresist film 10 is applied except those regions above predetermined positions where the grooves are later formed in the n-type silicon substrate 1. The conductive layer 15 may be formed of a material such as W, Mo, $WSi_2$, and heavily-doped polysilicon.

Figure 12B:
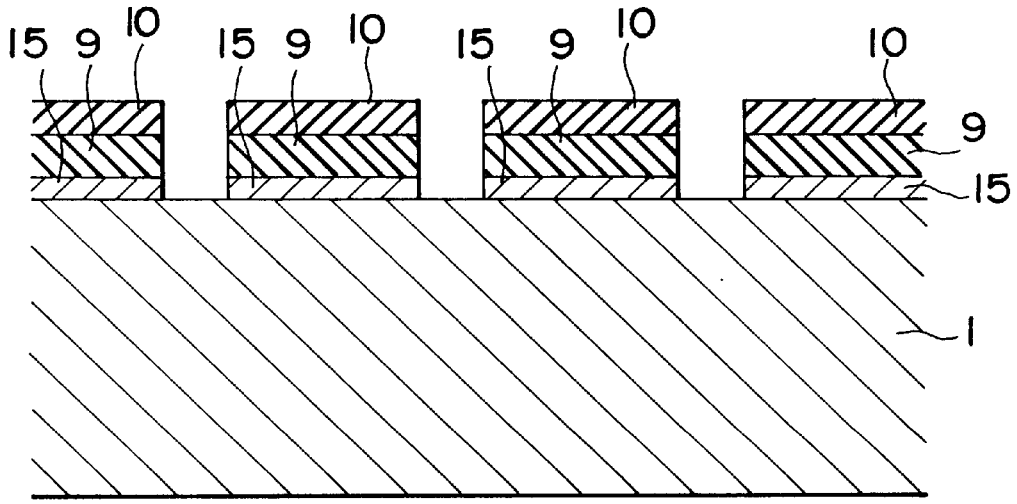

Then, as illustrated in FIG. 12B, the conductive layer 15 and the $Si_3N_4$ film 9 are locally removed by reactive ion etching with the photoresist film 10 used as a mask.

Figure 12C:
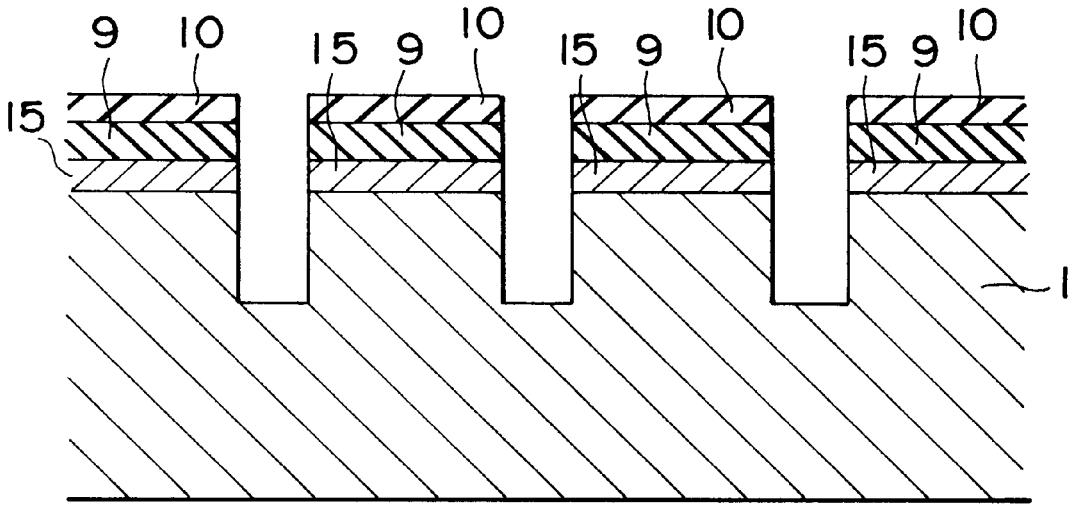

As illustrated in FIG. 12C, the n-type silicon substrate 1 is trenched by reactive ion etching with the photoresist film 10 used as a mask to form the grooves having a predetermined depth.

Figure 12D:
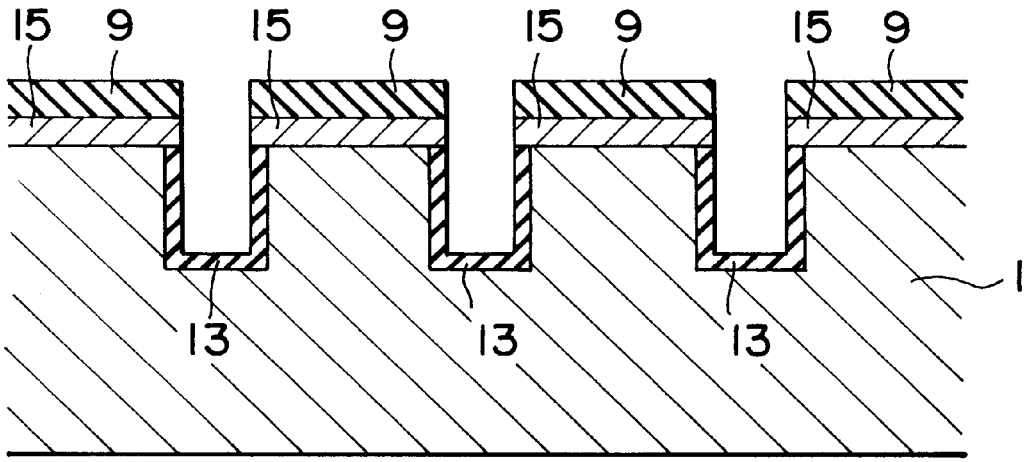

Thereafter, as illustrated in FIG. 12D, the photoresist film 10 is removed. Thereafter, an internal surface of each groove formed in the n-type silicon substrate 1 is lightly oxidized. If the conductive layer 15 is formed of heavily-doped polysilicon, each end of the conductive layer 15 in FIG. 12D is also oxidized.

Figure 12E:
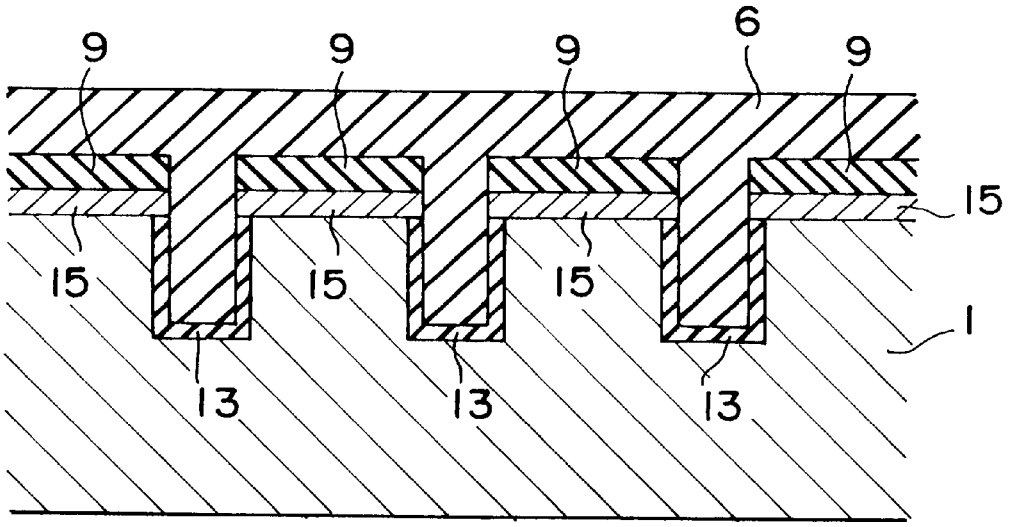

Then, as illustrated in FIG. 12E, the BPSG film 6 as an insulator film is grown thick on the $Si_3N_4$ film 9 by chemical vapor deposition and fills the grooves formed in the n-type silicon substrate 1. By heat treatment, the BPSG film 6 is planarized through reflowing. Instead of the BPSG film 6, a polysilicon film may be used as the insulator film. For planarization, use may be made of a coating film. It is possible to improve the flatness by a combination of various planarization techniques.

Figure 12F:
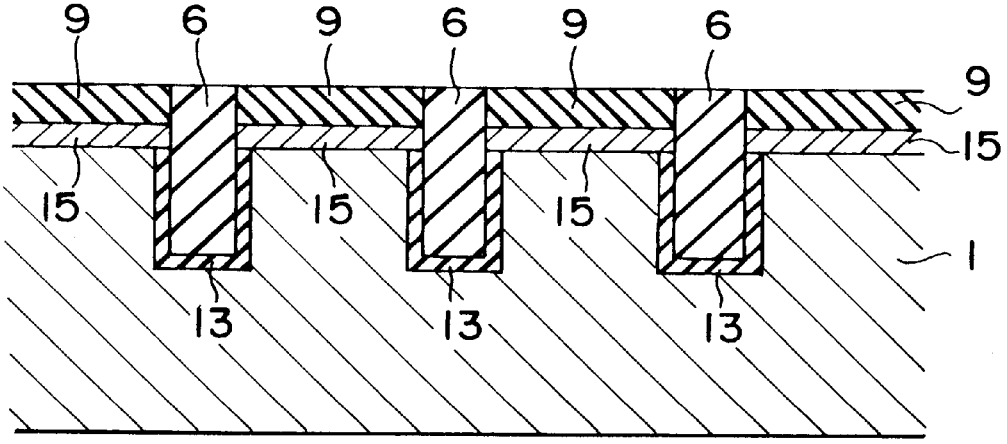

Next, as illustrated in FIG. 12F, the BPSG film 6 is etched back by reactive ion etching throughout its overall surface until the $Si_3N_4$ film 9 is exposed. Alternatively, the $Si_3N_4$ film 9 may be exposed by chemical mechanical polishing with an excellent flatness.

Figure 12G:
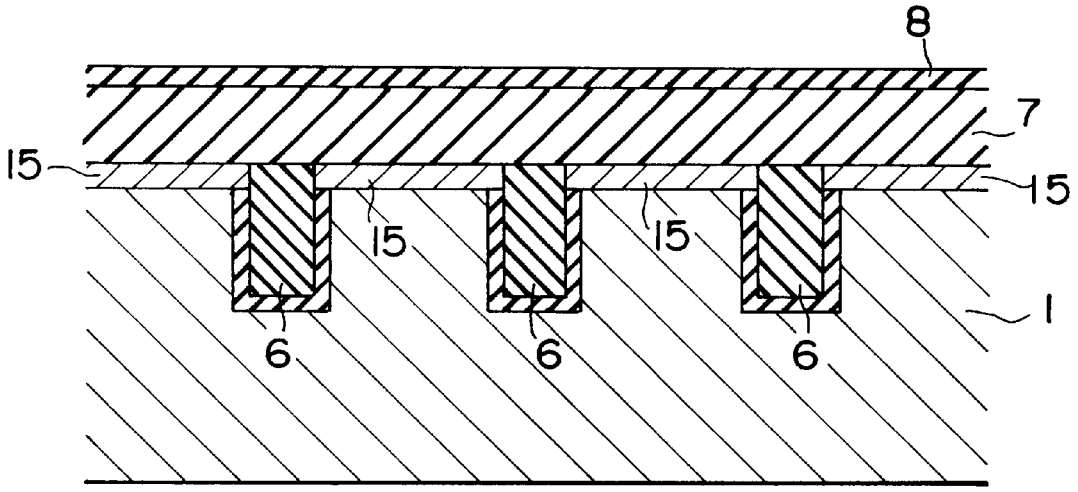

Then, the $Si_3N_4$ film 9 is removed together with a part of the BPSG film 6. Thereafter, as illustrated in FIG. 12G, the $SiO_2$ film 7 and the $Si_3N_4$ film 8 are successively deposited on an overall surface of the conductive layer 15 and the BPSG film 6 to thicknesses of about $5000\times10^{-8}$ cm and about $1500\times10^{-8}$ cm, respectively.

Figure 12H:
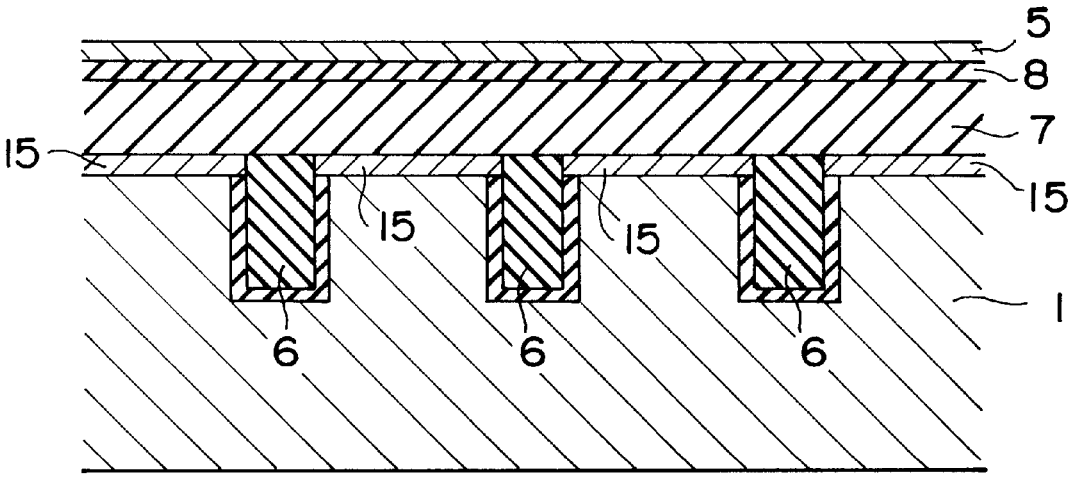
Figure 12I:
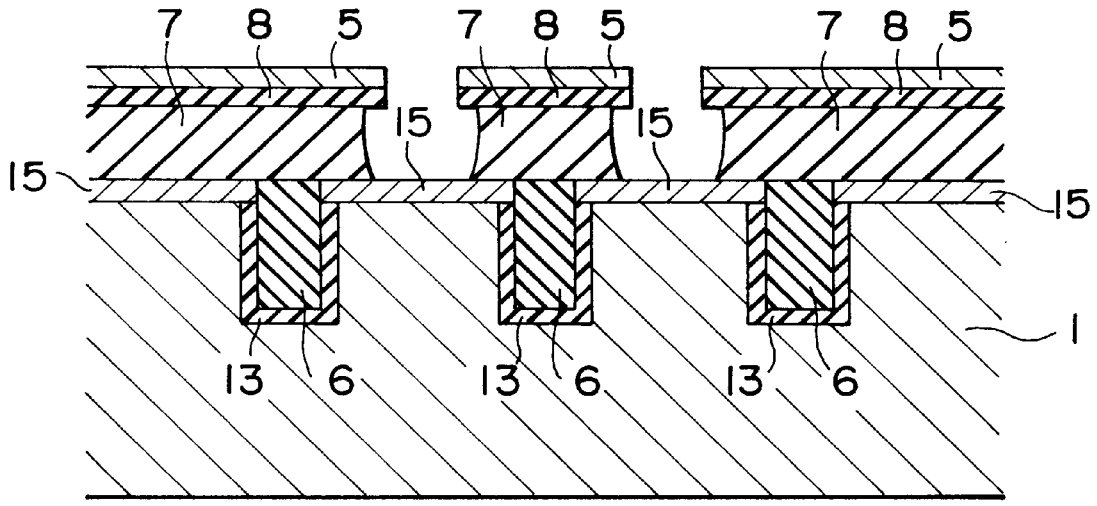

Subsequently, as illustrated in FIG. 12H, the gate electrode 5 is formed on the $Si_3N_4$ film 8 to a thickness of about $1500\times10^{-8}$ cm by sputtering a gate material. The gate material may be W, Mo, or $WSi_2$.

The subsequent steps are similar to those described in conjunction with the first embodiment.

Specifically, as illustrated in FIG. 121, the gate electrode 5, the $Si_3N_4$ film 8, and the $SiO_2$ film 7 are locally etched by the use of photolithography and reactive ion etching until the conductive layer 15 is exposed. In this manner, a plurality of small holes are formed through the gate electrode 5, the $Si_3N_4$ film 8, and the $Si_2$ film 7.

Figure 12J:
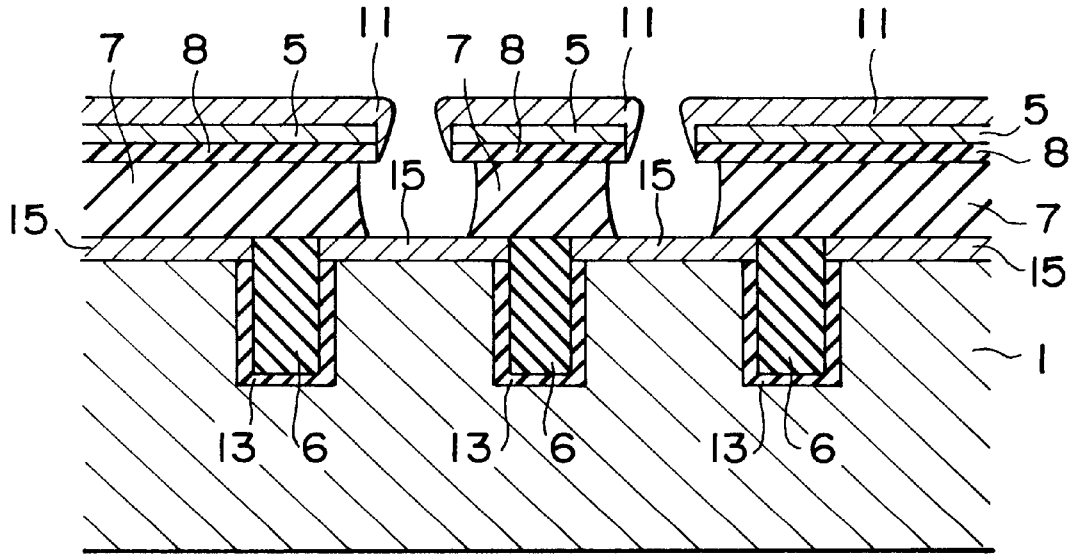

Then, as illustrated in FIG. 12J, rotary oblique deposition of a sacrificial layer material is carried out by the use of a vacuum deposition device. The sacrificial layer material is deposited on the gate electrode 5 and also adhered to the side walls of the holes in the gate electrode 5 and the $Si_3N_4$ film 8 to form a sacrificial layer 11. The sacrificial layer 11 may be formed of the material such as MgO, Al, and AlO, as described in conjunction with the first embodiment.

Figure 12K:
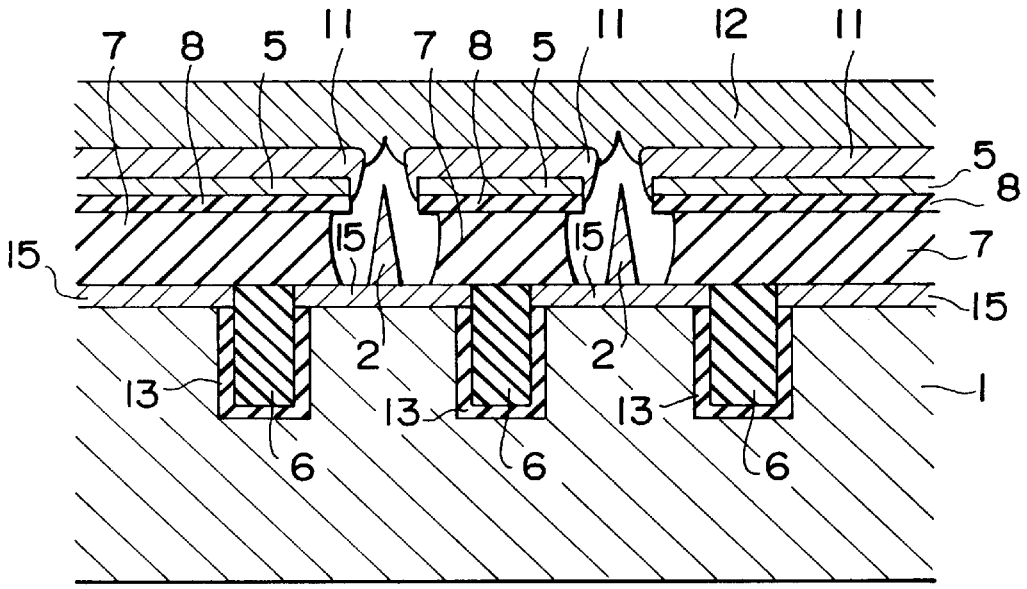

Subsequently, an emitter cone material 12 is deposited on the conductive layer 15 in a direction perpendicular thereto. As a consequence, as illustrated in FIG. 12K, the emitter cones 2 of a Spindt type are formed. The emitter cone material 12 may be Mo, TiC, ZrC, Ni, TiN, or ZrN, as described in conjunction with the first embodiment.

Figure 12L:
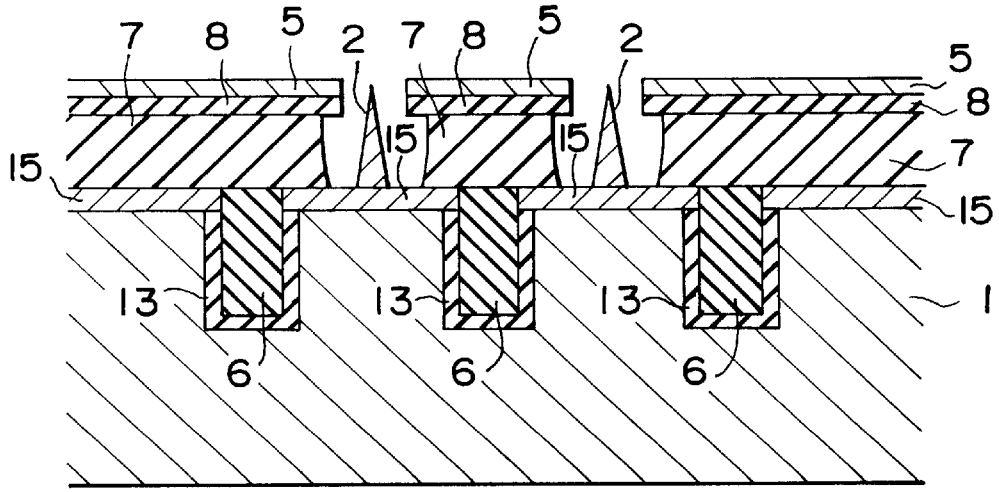

Finally, the sacrificial layer 11 is etched to lift off the emitter cone material 12 left on the sacrificial layer 11 in the preceding step. In this manner, the field emission cold cathode of the fourth embodiment is obtained as illustrated in FIG. 12L.

In the above-mentioned steps, specific numerical values are recited for convenience of description. However, this invention is not restricted to those conditions described this embodiment.

In this embodiment, the conductive layer 15 is interposed between the silicon substrate 1 and the bottom of the emitter cones 2. As seen from the figures, the illustrated structure is a variation of the second embodiment. It will be understood that the similar concept can be applied also to the first embodiment to obtain a field emission cold cathode of a modified structure illustrated in FIG. 13.

Figure 13:
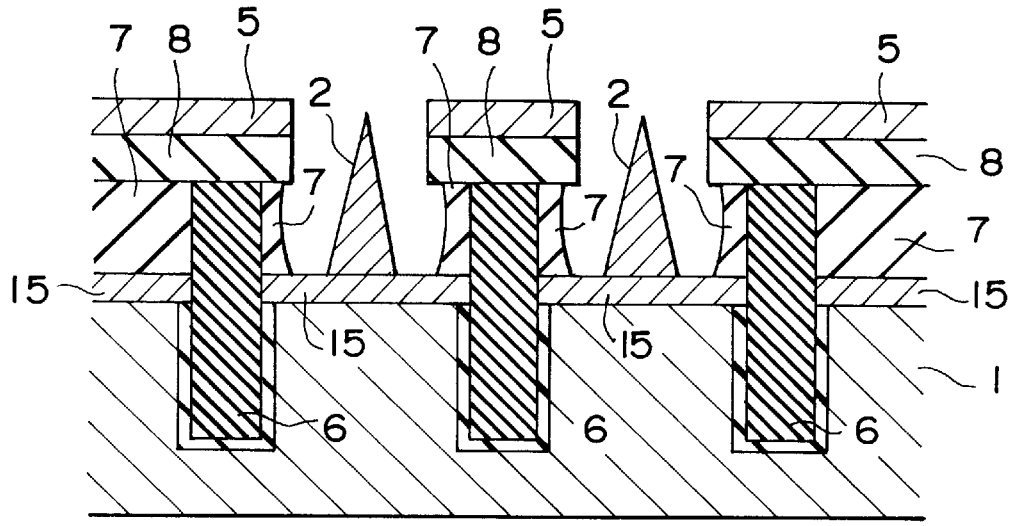
FIG. 13 is a sectional view of a modification of a field emission cold cathode which is a combination of the first and the fourth embodiments.

In order to manufacture the field emission cold cathode of the modified structure in FIG. 13, the method described in conjunction with the first embodiment is modified as follows.

In the step of FIG. 6A, the conductive layer 15, the $SiO_2$ film 7, and the $Si_3N_4$ film 9 are successively deposited on the n-type silicon substrate 1. On the $Si_3N_4$ film 9, the photoresist film 10 is applied in the manner similar to the first embodiment.

In the step of FIG. 6E, the conductive layer 15, the $Si_2$ film 7, and the $Si_3N_4$ film 9 are locally removed in the manner similar to the first embodiment.

In the step of FIG. 61, the gate electrode 5, the $Si_3N_4$ film 8, and the $SiO_2$ film 7 are locally etched by the use of photolithography and reactive ion etching until the conductive layer 15 is exposed. In this manner, a plurality of small holes are formed through the gate electrode 5, the $Si_3N_4$ film 8, and the $Si_2$ film 7.

In the step of FIG. 6K, the emitter cone material 12 is deposited on the conductive layer 15 in a direction perpendicular thereto.

Fifth Embodiment

Figure 14:
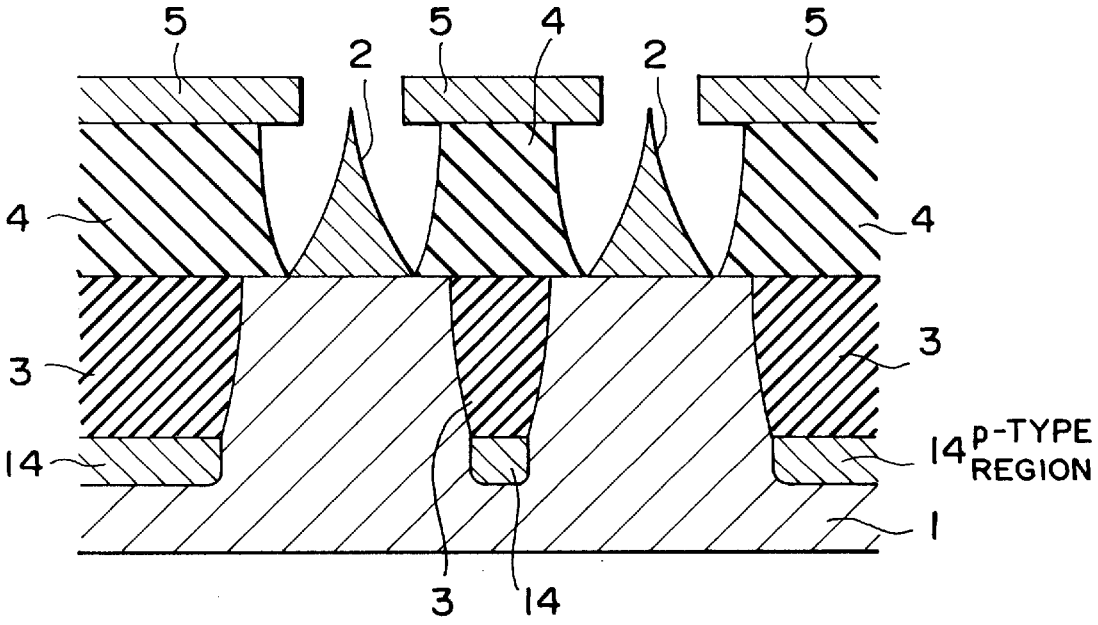
FIG. 14 is a sectional view of a field emission cold cathode according to a fifth embodiment of this invention.

Referring to FIG. 14, a field emission cold cathode according to a fifth embodiment of this invention comprises an n-type silicon substrate 1, a plurality of emitter cones 2 formed on the n-type silicon substrate 1, a buried insulator layer 3 formed in the n-type silicon substrate 1, a plurality of p-type regions 14 formed in the n-type silicon substrate 1, an insulator layer 4, and a gate electrode 5. The buried insulator layer 3 surrounds those regions of the n-type silicon substrate 1 right under the emitter cones 2. The p-type regions 14 are formed under the buried insulator layer 3.

In the field emission cold cathode of this embodiment, the p-type regions 14 form depletion regions in the n-type silicon substrate 1 right below the emitter cones 2. The depletion regions formed by adjacent ones of the p-type regions 14 in FIG. 14 are expanded from each other and finally brought into contact with each other at a pin point region. As a result, a so-called pinch-off is caused to occur at the pin point region.

Therefore, the resistance value of the n-type silicon substrate 1 right under the emitter cones 2 is increased. Thus, the field emission cold cathode of this embodiment is capable of preventing continuous discharge.

Figure 15:
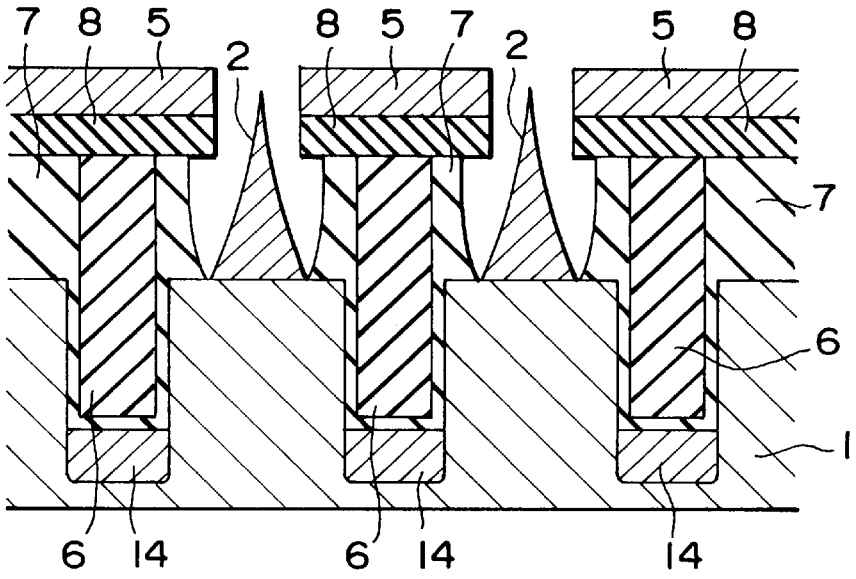
FIG. 15 is a sectional view of a variation of a field emission cold cathode which is a combination of the first and the fifth embodiments.
Figure 16:
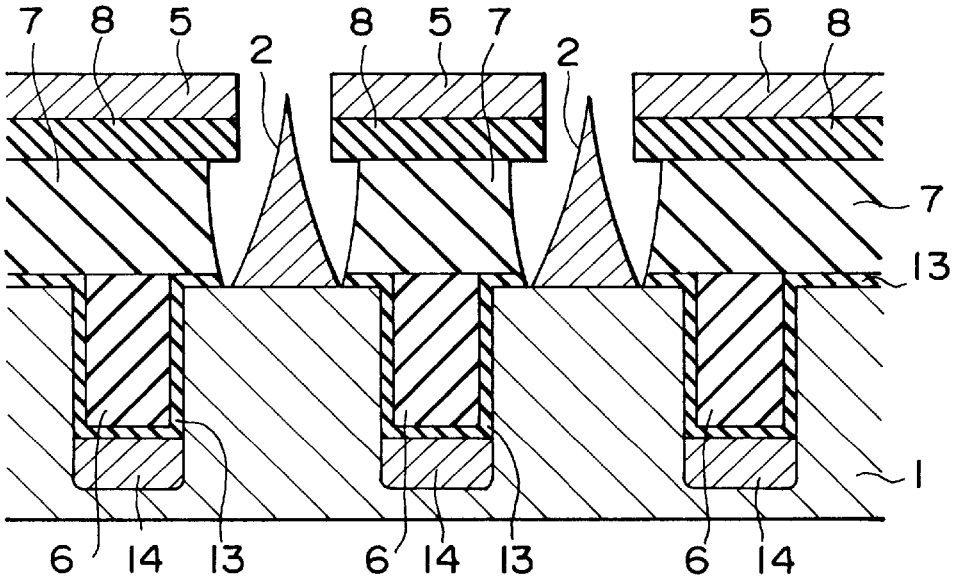
FIG. 16 is a sectional view of another variation of a field emission cold cathode which is a combination of the second and the fifth embodiments.
Figure 17:
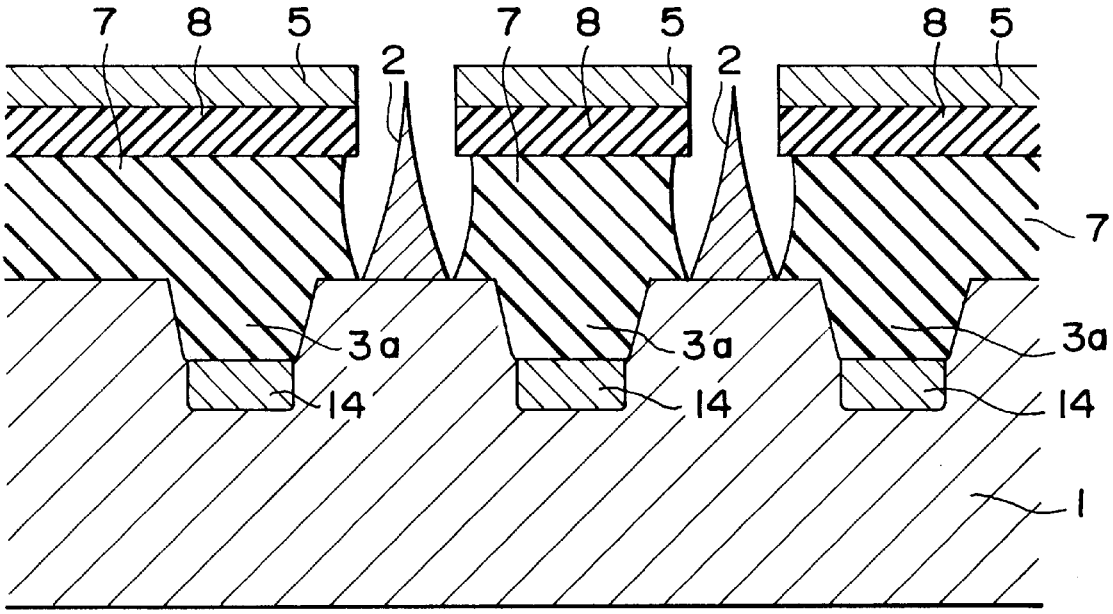
FIG. 17 is a sectional view of still another variation of a field emission cold cathode which is a combination of the third and the fifth embodiments.

Referring to FIGS. 15 through 17, the first through the third embodiments are modified to be combined with the fifth embodiment, namely, to include the p-type regions, respectively.

In order to manufacture the field emission cold cathodes shown in FIGS. 15 through 17, the processes described in conjunction with the first through the third embodiments will be modified as follows. Specifically, after the n-type silicon substrate 1 is locally etched with the photoresist used as a mask (FIG. 6C; FIG. 8C; FIG. 10C), an additional step is carried out in which boron is vertically ion-implanted into the n-type silicon substrate 1 at the bottom of each groove formed by local etching. The ion implantation is followed by the subsequent steps (FIGS. 6D-6L; FIG. 8D-8L; FIG. 10D-10J). Thus, the field emission cold cathodes shown in FIGS. 15 through 17 are obtained, respectively.

Although not shown, the fourth embodiment can also be similarly modified to be combined with the fifth embodiment, namely, to include the p-type regions 14. In this case, the process described in conjunction with the fourth embodiment will be modified as follows. Specifically, after the n-type silicon substrate 1 is trenched to form a plurality of grooves having a predetermined depth (FIG. 12C), an additional step is carried out in which boron is vertically ion-implanted into the n-type silicon substrate 1 at the bottom of each groove. Thereafter, the subsequent steps (FIGS. 12D-12L) are carried out.

Sixth Embodiment

Figure 18:
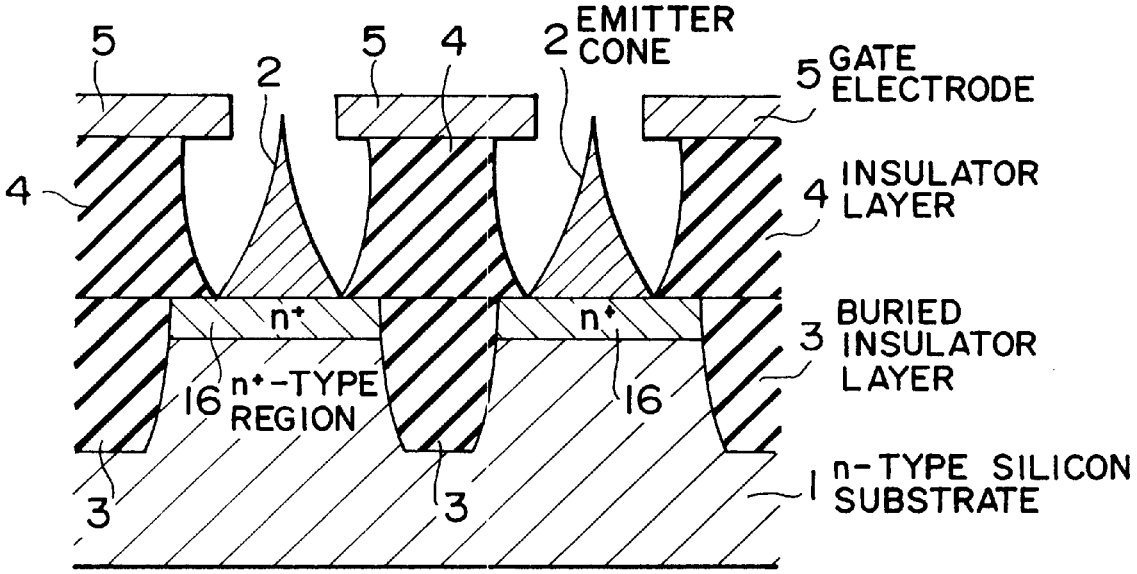
FIG. 18 is a sectional view of a field emission cold cathode according to a sixth embodiment of this invention.

Referring to FIG. 18, a field emission cold cathode according to a sixth embodiment of this invention comprises an n-type silicon substrate 1, a plurality of $n^+$-type regions 16 formed in the n-type silicon substrate 1, a plurality of emitter cones 2 formed on the $n^+$-type regions 16, a buried insulator layer 3 formed in the n-type silicon substrate 1, an insulator layer 4, and a gate electrode 5. The $n^+$-type regions 16 are heavily-doped n-type regions formed by diffusing impurities in the n-type silicon substrate 1. Each of the $n^+$-type regions is formed in the vicinity of the surface of the n-type silicon substrate 1. The buried insulator layer 3 surrounds the $n^+$-type regions 16 and underlying regions of the n-type silicon substrate 1 right under the emitter cones 2. Each of the emitter cones 2 is formed on the $n^+$-type regions 16 in one-to-one correspondence. Thus, each of the $n^+$-type regions 16 is interposed between the n-type silicon substrate 1 and the bottom of each of the emitter cones 2.

In the field emission cold cathode of this embodiment, each of the $n^+$-type regions 16 is interposed between the bottom of each emitter cone 2 and the n-type silicon substrate 1 as described above. Therefore, each emitter cone 2 is connected to the n-type silicon substrate 1 with excellent ohmic contact kept therebetween. Furthermore, upon emitting operation of the field emission cold cathode, contact resistance between the bottom of each emitter cone 2 and the n-type silicon substrate 1 is suppressed so that the emitting operation is stable. In addition, like in the first through the fifth embodiments described above, the field emission cold cathode of this embodiment can effectively avoid continuous discharge.

This embodiment can be combined with each of the first through the third embodiments. In that event, the $n^+$-type regions 16 are formed as will hereafter be described.

In case where this embodiment is combined with the first embodiment, phosphorus is ion-implanted to the substrate surface by the known ion implantation process (hereafter abbreviated to the I/I process) after a plurality of small holes are formed through the gate electrode 5, the $Si_3N_4$ film 8, and the $SiO_2$ film 7 (FIG. 6I) and before the sacrificial layer 11 is formed (FIG. 6J). Generally, the I/I process comprises the step of irradiating the ion beam onto a solid to introduce the impurities in the vicinity of the surface of the solid.

In case where this embodiment is combined with the second embodiment, phosphorus is ion-implanted to the substrate surface by the I/I process after the BPSG film 6 is filled in the grooves formed in the n-type silicon substrate 1 and etched back until the $Si_3N_4$ film 9 is exposed (FIG. 8F) and before the $SiO_2$ film 7 and the $Si_3N_4$ film 8 are deposited (FIG. 8G). Alternatively, the I/I process may be carried out before the $Si_3N_4$ film is removed or immediately after the $Si_3N_4$ film 9 is removed together with a part of the BPSG film 6. In either event, process conditions such as energy conditions must be appropriately selected so that the $n^+$-type regions 16 are formed in the vicinity of the n-type silicon substrate 1.

In case where this embodiment is combined with the third embodiment, phosphorus is ion-implanted to the substrate surface by the I/I process after the field oxide film 3*a* is formed (FIG. 10D) and before the combined $SiO_2$ film 7 is formed (FIG. 10E). Alternatively, the I/I process may be carried out before the $Si_3N_4$ film is removed or immediately after the $Si_3N_4$ film 9 is removed. In either event, process conditions such as energy conditions must be appropriately selected so that the $n^+$-type regions 16 are formed in the vicinity of the n-type silicon substrate 1.

In each of the above-mentioned cases, heat treatment (annealing) is carried out in an $N_2$ atmosphere at 900° C. for 30 minutes in order to activate the ions implanted.

It will be understood that the sixth embodiment can be combined also with the fifth embodiment, although description thereof is omitted.

Figure 19:
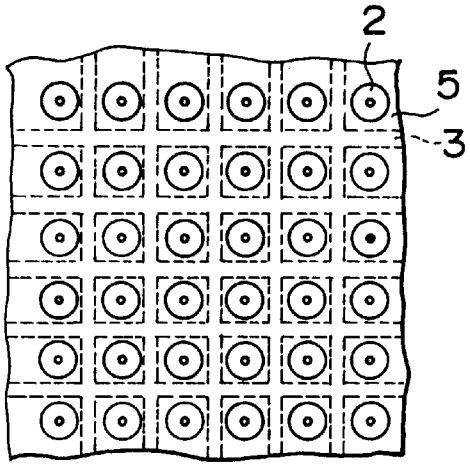
FIG. 19 is a view for describing a manner of surrounding emitter cones by a buried insulator layer.
Figure 20:
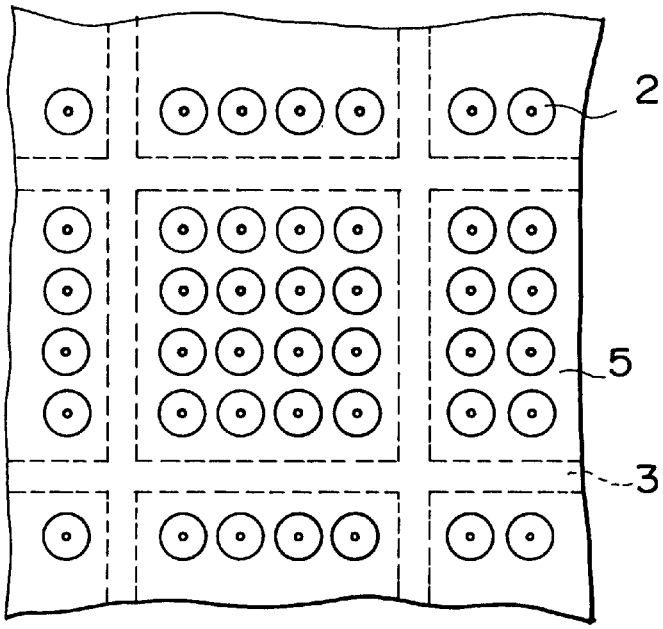
FIG. 20 is a view for describing another manner of surrounding emitter cones by the buried insulator layer.

In the foregoing description, the buried insulator layer 3 is formed to surround each underlying region of the n-type silicon substrate 1 right under each emitter cone 2, as illustrated in FIG. 19. Alternatively, the buried insulator layer 3 may surround a wider region corresponding to a group of the emitter cones 2, as illustrated in FIG. 20. In the latter case, the area to be surrounded by the buried insulator layer 3 is determined by the resistivity of the silicon substrate 1 and the resistance value required to inhibit continuous discharge.

In any event, the area surrounded by the buried insulator layer 3 will be called an inside area herein under.

In the following, description will be made about calculation of the maximum inside area which can be surrounded by the buried insulator layer 3.

Generally, the resistance value R is calculated by:

$$R=\rho/4a,$$

where ρ represents the resistivity of the silicon substrate and typically ranges between 10 and 100 Ω·cm, a, a radius of the inside region surrounded by the buried insulator layer 3 supposing that the region has a circular shape. In this embodiment, the region surrounded by the buried insulator layer 3 is not circular but is generally square. However, such difference is of no significance in approximately determining the resistance value and the maximum inside area.

If the electric current flows to the emitter cone 2 exceeds 20 mA, the emitter cone 2 may possibly be destroyed. Therefore, supposing that the initial voltage upon discharge from the parasitic capacitance ranges between 30 and 100 V, the resistance value R between 1.5 and 5 kΩ is required.

From the foregoing, if the region surrounded by the buried insulator layer 3 has a circular shape, the maximum radius is calculated between 5 and 160 μm.

In the manner mentioned above, the maximum inside area which can be practically surrounded by the buried insulator layer 3 is determined. A plurality of the emitter cones 2 which can be contained in the maximum inside area forms the above-mentioned group of the emitter cones.

Preferably, a practical maximum inside area surrounded by the buried insulator layer 3 may be smaller than the maximum inside area calculated as mentioned above, with a clearance left.

In order to confirm the effect of this invention, the present inventors carried out the experimental studies which will hereafter be described reciting the specific numerical values.

The silicon substrate used in the experiment had a resistivity of about 30Ω·cm. The initial voltage upon discharge from the parasitic capacitance was calculated to be approximately equal to 100 V.

The maximum current which can be supplied to the emitter cone is 20 mA. Therefore, the resistance value of the silicon substrate in the region right under the emitter cone is calculated to be 5 kΩ as a desired value.

The maximum inside area of the region surrounded by the buried insulator layer is calculated to be $7.065\times10^{-10}m^2$ (15 μm in radius), supposing that the region is circular.

In this experiment, the diameter of the bottom of each emitter cone was equal to 0.6 μm. An emitter cone group contained 100 emitter cones. The practical buried insulator layer an area slightly narrower than the calculated area for each emitter cone group. In this situation, the buried insulator layer practically had a square shape having one side equal to 20 μm, i.e., had an area of $4.0\times10^{-10}m^2$.

The distance from the surface of the silicon substrate to the bottom of the buried insulator layer (i.e., the depth of the buried insulator layer) was calculated to be about 3.3 μm from the initial voltage (about 100 V) upon discharge from the parasitic capacitance and the avalanche breakdown field (30 V/μm). In order to form the buried insulator layer of the above-mentioned depth, the process described in conjunction with the first embodiment was used in the experiment.

Even if the field emission cold cathode thus manufactured was applied with the voltage up to 120 V, neither drastic decrease in resistance value of the silicon substrate nor continuous discharge was observed.

By way of comparison, in the first conventional field emission cold cathode, drastic decrease in resistance value of the silicon substrate and continuous discharge were confirmed at around 20 V. As a result, the emitter cones were destroyed to cause short circuit.

As described above, this invention provides the field emission cold cathode capable of preventing continuous discharge.

In addition, high resistance is not always present between the emitter cones and the silicon substrate according to this invention. Thus, it is unnecessary to increase the drive voltage.

Furthermore, the field emission cold cathode of this invention requires none of a complicated manufacturing process, a high production cost, and an increased device size.

What is claimed is:

1. A field emission cold cathode comprising a semiconductor substrate, a plurality of sharp-pointed emitter cones formed on said semiconductor substrate at a predetermined interval to form an emitter array, and a gate electrode formed above said semiconductor substrate and having a plurality of gate holes for extracting electrons emitted from said emitter cones, wherein:

said semiconductor substrate has a plurality of grooves each of which surrounds an underlying region right under each of said emitter cones;

each of said grooves being filled with an insulator to form a buried insulator layer surrounding each of said underlying regions.

2. A field emission cold cathode as claimed in claim 1, further comprising a conductive layer formed on said semiconductor substrate to be separated by said grooves into a plurality of conductive layer portions, each of said emitter cones being formed on each of said conductive layer portions.

3. A field emission cold cathode as claimed in claim 2, wherein each of said conductive layer portions is greater in area than the bottom of each corresponding emitter cone formed thereon.

4. A field emission cold cathode as claimed in claim 1, wherein said semiconductor substrate comprises an n-type silicon substrate.

5. A field emission cold cathode as claimed in claim 1, wherein said semiconductor substrate is an n-type silicon substrate, said field emission cold cathode further comprising a plurality of $n^+$-type regions formed in said n-type silicon substrate in the vicinity of the surface of said substrate so that said $n^+$-type regions are surrounded by said grooves, said $n^+$-type regions having an impurity concentration higher than that of said n-type silicon substrate, each of said emitter cones being formed on each of said $n^+$-type regions.

6. A field emission cold cathode as claimed in claim 1, wherein said semiconductor substrate further comprises a plurality of p-type regions formed under said grooves, respectively.

7. A field emission cold cathode as claimed in claim 1, wherein each of said grooves has a depth determined by an initial voltage upon discharge from a parasitic capacitance and an avalanche breakdown field.

8. A field emission cold cathode as claimed in claim 1, wherein said insulator comprises a silica glass film with boron and phosphorus mixed therein.

9. A field emission cold cathode as claimed in claim 1, wherein said insulator comprises a polysilicon film.

10. A field emission cold cathode as claimed in claim 1, wherein said insulator comprises a field oxide film.

11. A field emission cold cathode as claimed in claim 1, further comprising an oxide film formed on said semiconductor substrate and a nitride film formed on said oxide film, said gate electrode being formed above said semiconductor substrate through said oxide film and said nitride film, said oxide film and said nitride film having oxide-film holes and nitride-film holes so as to surround said emitter cones, each of said oxide-film and nitride-film holes being greater in area than each of said gate holes.

12. A field emission cold cathode as claimed in claim 11, wherein said oxide film and said nitride film comprise $SiO_2$ and $Si_3N_4$, respectively.

13. A field emission cold cathode as claimed in claim 1, wherein said gate electrode is formed of a metal material selected from a group including W, Mo, and $WSi_2$.

14. A field emission cold cathode as claimed in claim 1, wherein said emitter cones are formed of a metal material selected from a group including Mo, TiC, ZrC, Ni, TiN, and ZrN.

15. A field emission cold cathode as claimed in claim 1, wherein said conductive layer is formed of a metal material selected from a group including W, Mo, and $WSi_2$.

16. A field emission cold cathode as claimed in claim 1, wherein said conductive layer is formed of heavily-doped polysilicon.

17. A field emission cold cathode comprising a semiconductor substrate, a plurality of sharp-pointed emitter cones formed on said semiconductor substrate at a predetermined interval to form an emitter array, and a gate electrode formed above said semiconductor substrate and having a plurality of gate holes for extracting electrons emitted from said emitter cones, wherein:

said emitter cones are divided into a plurality of emitter cone groups each of which comprises a predetermined number of ones of said emitter cones;

said semiconductor substrate having a plurality of grooves each of which surrounds an underlying region right under each emitter cone group;

said grooves being filled with an insulator to form a buried insulator layer surrounding each of said underlying regions.

18. A field emission cold cathode as claimed in claim 17, wherein each of said emitter cone groups is arranged within a predetermined area of said semiconductor substrate, said predetermined area being determined by the resistivity and a desired resistance value of said semiconductor substrate.

19. A field emission cold cathode as claimed in claim 2, wherein said semiconductor substrate comprises an n-type silicon substrate.

20. A field emission cold cathode as claimed in claim 3, wherein said semiconductor substrate comprises an n-type silicon substrate.

* * * * *